US011220729B2

(12) United States Patent
Shyam et al.

(10) Patent No.: US 11,220,729 B2
(45) Date of Patent: Jan. 11, 2022

(54) ALUMINUM ALLOY COMPOSITIONS AND METHODS OF MAKING AND USING THE SAME

(71) Applicants: UT-Battelle, LLC, Oak Ridge, TN (US); FCA US LLC, Auburn Hills, MI (US); NEMAK USA, Inc., Southfield, MI (US)

(72) Inventors: Amit Shyam, Knoxville, TN (US); Yukinori Yamamoto, Knoxville, TN (US); Dongwon Shin, Knoxville, TN (US); Shibayan Roy, Kharagpur (IN); James A. Haynes, Knoxville, TN (US); Philip J. Maziasz, Oak Ridge, TN (US); Adrian Sabau, Knoxville, TN (US); Andres F. Rodriguez-Jasso, Garcia (MX); Jose A. Gonzalez-Villarreal, Monterrey (MX); Jose Talamantes-Silva, Monterrey (MX); Lin Zhang, Windsor (CA); Christopher R. Glaspie, Rochester Hills, MI (US); Seyed Mirmiran, Auburn Hills, MI (US)

(73) Assignees: UT-Battelle, LLC, Oak Ridge, TN (US); FCA US LLC, Auburn Hills, MI (US); NEMAK USA, Inc., Southfield, MI (US)

( * ) Notice: Subject to any disclaimer, the term of this patent is extended or adjusted under 35 U.S.C. 154(b) by 1163 days.

(21) Appl. No.: 15/160,926

(22) Filed: May 20, 2016

(65) Prior Publication Data

US 2017/0335437 A1 Nov. 23, 2017

(51) Int. Cl.

| | |
|---|---|
| ***C22C 21/18*** | (2006.01) |
| ***C22C 21/14*** | (2006.01) |
| ***C22C 21/16*** | (2006.01) |
| ***C22F 1/057*** | (2006.01) |
| ***C22C 21/12*** | (2006.01) |

(52) U.S. Cl.

CPC ..... *C22C 21/18* (2013.01); *C22C 21/12* (2013.01); *C22C 21/14* (2013.01); *C22C 21/16* (2013.01); *C22F 1/057* (2013.01)

(58) Field of Classification Search

None

See application file for complete search history.

(56) References Cited

U.S. PATENT DOCUMENTS

| | | | | |
|---|---|---|---|---|
| 1,744,545 | A | 1/1930 | Hall et al. | |
| 2,022,686 | A | 12/1935 | Nock | |
| 2,706,680 | A * | 4/1955 | Criner | C22C 21/00 148/416 |
| 2,781,263 | A | 2/1957 | Gresham et al. | |
| 2,784,126 | A | 3/1957 | Criner | |
| 3,826,688 | A | 7/1974 | Levy | |
| 6,074,498 | A | 6/2000 | Waldron et al. | |
| 2005/0269000 | A1 | 12/2005 | Denzer et al. | |
| 2016/0168665 | A1 | 6/2016 | Rafetzeder | |
| 2016/0304995 | A1 * | 10/2016 | Sigli | C22C 21/12 |

FOREIGN PATENT DOCUMENTS

| | | |
|---|---|---|
| EP | 1727921 B1 | 12/2006 |
| EP | 0 348 179 | 7/2016 |
| EP | 3 072 985 | 9/2016 |
| JP | 07252574 A * | 10/1995 |
| JP | H07 252574 | 10/1995 |
| WO | WO 2005/098072 | 10/2005 |
| WO | WO 2007/106772 | 9/2007 |
| WO | WO 2008/072972 | 6/2008 |
| WO | WO 2014/167191 | 10/2014 |
| WO | WO 2016/116805 | 7/2016 |

OTHER PUBLICATIONS

"Properties and Physical Metallurgy." Aluminum—Properties and Physical Metallurgy, by Hatch JE Ed, ASM International, 1984, p. 224. (Year: 1984).*

International Search Report and Written Opinion issued for International Application No. PCT/US2018/057588 dated Jan. 21, 2019.

International Search Report and Written Opinion issued for International Application No. PCT/US2017/033535 dated Jul. 19, 2017 (12 pages).

American Foundry Society, "Advancing Aluminum," *Modern Casting*, pp. 45-50, Mar. 2015.

Schmitz et al., "Surface tension of liquid Al—Cu binary alloys," *Int. J. Mat. Res.*, 100(11): Nov. 2009.

Final Office Action issued for U.S. Appl. No. 15/594,434 dated Oct. 20, 2020.

Final Office Action issued for U.S. Appl. No. 16/171,201 dated Oct. 28, 2020.

Davis, "Age Hardening," *Aluminum and Aluminum Alloys*, p. 309-310, Dec. 1993.

* cited by examiner

*Primary Examiner* — Anthony M Liang

(74) *Attorney, Agent, or Firm* — Klarquist Sparkman, LLP

(57) ABSTRACT

The present disclosure concerns embodiments of aluminum alloy compositions exhibiting microstructural stability and strength at high temperatures. The disclosed aluminum alloy compositions comprise particular combinations of components that contribute the ability of the compositions to exhibit improved microstructural stability and hot tearing resistance as compared to conventional alloys. Also disclosed herein are embodiments of methods of making and using the alloys.

13 Claims, 17 Drawing Sheets

ALUMINUM ALLOY COMPOSITIONS AND METHODS OF MAKING AND USING THE SAME

ACKNOWLEDGMENT OF GOVERNMENT SUPPORT

This invention was made with government support under Contract No. DE-AC05-00OR22725 awarded by the U.S. Department of Energy. The government has certain rights in the invention.

FIELD

The present disclosure concerns embodiments of aluminum alloy compositions exhibiting microstructural and strength stability as well as hot tearing resistance, and methods of making and using such alloys.

PARTIES TO JOINT RESEARCH AGREEMENT

The research work described here was performed under a Cooperative Research and Development Agreement (CRADA) between Oak Ridge National Laboratory (ORNL), Nemak USA Inc., and FCA US, LLC.

BACKGROUND

Cast aluminum alloys are used extensively in various industries, such as for automobile powertrain components. Among materials for these components, the aluminum alloys for engine cylinder head applications have a unique combination of physical, thermal, mechanical and castability requirements. Government regulations require increased vehicle efficiency and have pushed the maximum operating temperature of cylinder heads to approximately 250° C. It is projected that this temperature will need to increase to 300° C. to meet the demand of future vehicular efficiency requirements, particularly CAFE 2025 standards. Conventional aluminum alloys cannot economically address the requirements of cylinder heads operating at 300° C. The widely used alloys for cylinder heads, such as 319 and A356, are not able to meet the temperature and microstructure/strength stability requirements at temperatures greater than 250° C. A need exists in the art for alloys that exhibit strength & microstructure stability at temperatures higher than 250° C.

SUMMARY

Disclosed herein are embodiments of aluminum alloy compositions, comprising copper, zirconium, manganese, titanium, aluminum, and other components. In some embodiments, the aluminum alloy compositions can further comprise additional titanium introduced by the addition of a grain refiner to the composition. The disclosed aluminum alloy compositions exhibit improved hot tearing resistance as compared to conventional alloys and also exhibit improved microstructural and strength stability. In some embodiments, the aluminum alloy compositions can comprise strengthening precipitates having an aspect ratio ranging from 30 to 40. In yet additional embodiments, the aluminum alloy compositions (or parts cast therefrom) can exhibit an average hot tearing value ranging from 1.5 to 2.5. Also disclosed herein are embodiments of methods of making and using the disclosed compositions.

The foregoing and other objects, features, and advantages of the claimed invention will become more apparent from the following detailed description, which proceeds with reference to the accompanying figures.

BRIEF DESCRIPTION OF THE DRAWINGS

FIGS. 5A and 5B show as-aged condition embodiments; FIG. 5C shows that precipitates within the Al5CuNi alloy remain morphologically stable and crystallographically oriented after 300° C. preconditioning; FIG. 5D shows precipitates that coarsen to a size scale where they are large enough to be observed in a scanning electron microscope (SEM) after preconditioning.

FIG. 7A is a bright field TEM image of the Al5CuNi alloy strengthening precipitate in the as-aged condition; FIG. 7B is a HAADF (high angle annular dark field) image.

FIGS. 12A and 12B show precipitates for Al5CuNi and FIGS. 12C and 12D show precipitates for Al7CuMnZr.

FIG. 14A shows the Q Phase at 190° C. after 5 hours; FIG. 14B shows an embodiment after a 5 hour treatment at 190° C.; FIG. 14C shows a Q Phase of θ' after 16 hours at 190° C.; FIG. 14D shows an image of θ' after 16 hours at 190° C.; FIG. 14E shows an image of θ' after 200 hours at 300° C.; and FIG. 14F shows an image of θ after 200 hours at 300° C.

DETAILED DESCRIPTION

I. Explanation of Terms

Figure 1:
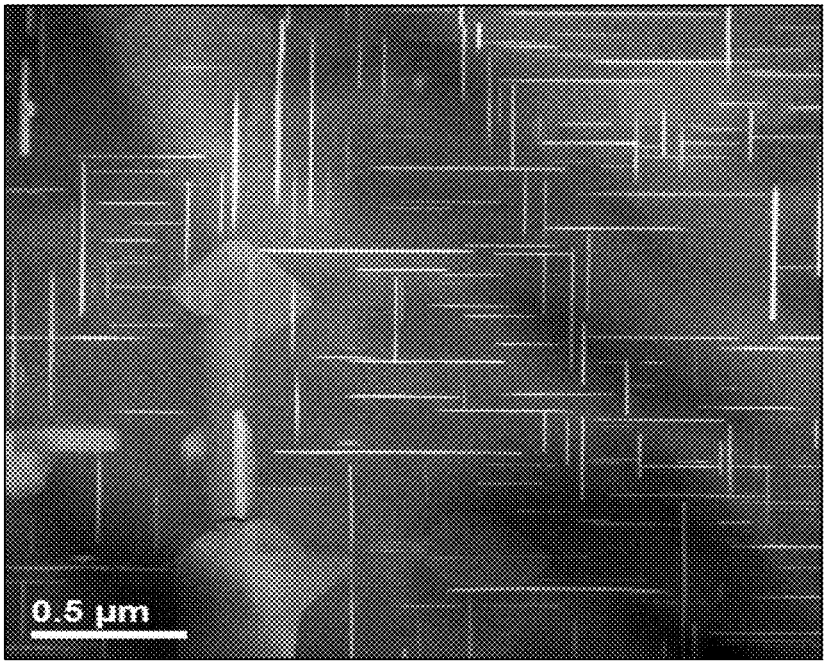
FIG. 1 is an HRTEM image showing coarse θ' precipitates in a representative cast aluminum alloy with improved high temperature stability of microstructure (matrix zone axis is <100>).

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and compounds similar or equivalent to those described herein can be used in the practice or testing of the present disclosure, suitable methods and compounds are described below. The compounds, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

The following terms and definitions are provided:

Alloy: A metal made by combining two or more different metals. For example, an aluminum alloy is a metal made by combining aluminum and at least one other metal.

Vickers Hardness Test: A test used to determine the hardness of an alloy, wherein hardness relates to the resistance of the alloy to indentation. Vickers hardness can be determined by measuring the permanent depth of an indentation formed by a Vickers Hardness tester, such as by measuring the depth or the area of an indentation formed in the alloy using the tester. Methods of conducting a Vickers hardness test are disclosed herein.

Hot Tearing: A type of alloy casting defect that involves forming an irreversible failure (or crack) in the cast alloy as the cast alloy cools.

Representative Alloy Composition(s): This term refers to inventive compositions contemplated by the present disclosure Solution Treating/Treatment: Heating an alloy at a suitable temperature and holding it at that temperature long enough to cause one or more alloy composition constituents to enter into a solid solution and then cooling the alloy so as to hold the alloy composition constituents in solution.

II. Introduction

Disclosed herein are new cast aluminum alloy compositions that lead to improved elevated temperature microstructural stability and corresponding mechanical properties, as well as improved hot tearing resistance. The alloy compositions disclosed herein are based on an alloy design approach that entails incorporating coarse and yet coherent θ' precipitates that enable improved elevated temperature microstructural stability and mechanical properties. The alloy design approach disclosed herein is contrary to the conventional approach of incorporating fine strengthening precipitates. In conventional designs and methods, the fine strengthening precipitates lead to suitable mechanical properties at lower temperatures, but the precipitates coarsen rapidly at temperatures above 250° C. and also lose their coherency with the matrix. One unique aspect of the alloys disclosed herein is the coarse strengthening precipitates, which remain stable and coherent with the matrix at high temperatures (such as at or above 350° C.). These precipitates lead to suitable mechanical properties at lower temperature, but at elevated temperatures their mechanical and thermal properties are exceptional and much more stable than conventional alloys. Without being limited to a particular theory, it is currently believed that the elevated temperature microstructural stability of the alloys compositions disclosed herein can be attributed to the selective microsegregation of alloying elements in the bulk as well as coherent/semi-coherent interfaces of θ' precipitates. This microsegregation can "freeze" the precipitates into low energy states that renders them exceptionally stable to thermal exposure at high temperatures.

Alloy compositions disclosed herein also exhibit improved hot tearing resistance as compared to conventional alloys known in the art. Hot tearing susceptibility is a problem that plagues industries where intricate components and/or component designs are used, such as the automotive, aircraft, and aerospace industries. For example, many engine components must be able to resist hot tearing during production. The inventors have discovered that the alloy compositions disclosed herein exhibit surprisingly superior hot tearing resistance as compared to conventional alloys. In some embodiments, the inventors have discovered that hot tearing susceptibility can be substantially reduced and even eliminated by using alloys have the features described herein, by including non-conventional amounts of grain refiners.

III. Compositions

Disclosed herein are aluminum alloy compositions. The disclosed aluminum alloy compositions can be used to make cast aluminum alloys exhibiting microstructural stability and strength at high temperatures, such as the high temperatures associated with components used in automobiles, aerospace, and the like. Accordingly, the aluminum alloy compositions disclosed herein are able to meet the thermal, mechanical, and castability requirements in engine component manufacturing and use. In particular disclosed embodiments, the aluminum alloy compositions disclosed herein are made using an alloy design approach that includes incorporating coarse and yet coherent θ' precipitates that enable improved elevated temperature (such as 350° C.) microstructural stability and mechanical properties. In particular disclosed embodiments, the cast aluminum alloys exhibit microstructural stability and strength at temperatures above 300° C., such as 325° C., 350° C., or higher. The aluminum alloy compositions and cast aluminum alloys described herein exhibit improved microstructural stability and strength as compared to alloys know/used in the art, such as 319 alloys and A356 alloys. The alloy composition embodiments and process method embodiments disclosed herein provide alloys that exhibit properties that are surprisingly unexpected and contrary to properties observed for traditional alloys comprising fine strengthening precipitates. In some embodiments, the alloys disclosed herein comprise amounts of components that are unconventional in the art.

Embodiments of the aluminum alloy compositions described herein can comprise aluminum (Al), copper (Cu), zirconium (Zr), titanium (Ti), manganese (Mn), silicon (Si), iron (Fe), nickel (Ni), magnesium (Mg), cobalt (Co), antimony (Sb), vanadium (V), and combinations thereof. In particular disclosed embodiments, the aluminum alloy compositions consist essentially of aluminum (Al), copper (Cu), zirconium (Zr), titanium (Ti), manganese (Mn), silicon (Si), iron (Fe), nickel (Ni), magnesium (Mg), cobalt (Co), and antimony (Sb). In embodiments consisting essentially of these components, the compositions do not comprise, or are free of, components that deleteriously affect the microstructural stability and/or strength of the cast alloy composition or the hot tearing susceptibility obtained from this combination of components. Such embodiments consisting essentially of the above-mentioned components can include impurities and other ingredients that do not materially affect the physical characteristics of the aluminum alloy composition, but those impurities and other ingredients that do markedly alter the physical characteristics, such as the microstructural stability, strength, hot tearing, and/or other properties that affect performance at high temperatures, are excluded. In yet additional embodiments, the aluminum alloy compositions described herein can consist of aluminum (Al), copper (Cu), zirconium (Zr), titanium (Ti), manganese (Mn), silicon (Si), iron (Fe), nickel (Ni), magnesium (Mg), cobalt (Co), antimony (Sb), and any combination thereof.

As indicated above, the disclosed aluminum alloy composition comprise manganese. In particular disclosed embodiments, manganese facilitates alloying addition, particularly in embodiments comprising low silicon amounts (e.g., where silicon is present in an amount of less than 0.1 wt %). The manganese utilized in the disclosed compositions partitions in the strengthening precipitates and also to the interfaces. Even at low amounts, manganese facilitates the segregation to the interfaces leading to desirable high temperature stability.

Use of zirconium in the disclosed compositions also can facilitate microalloying. In particular disclosed embodiments, using low amounts of zirconium (e.g., 0.05-0.15 wt %) in combination with manganese can stabilize the interface to higher temperature. Without being limited to a particular theory of operation, it is currently believed that combining the manganese and zirconium can lower the interfacial energy synergistically and also act as double diffusion barriers on the semi-coherent (high energy) interface. In some embodiments, zirconium atoms are located on the matrix side and manganese atoms are located on the precipitate side of this interface. When titanium is used in the disclosed compositions, it can be located at sites similar to the zirconium, but typically is less effective as a high temperature stabilizer on its own (that is, when not used in combination with zirconium). The effectiveness of the titanium can be improved by adding additional titanium in conjunction with boron, such as by adding a grain refiner to the alloy composition. In some embodiments, using a grain refiner comprising titanium and boron can result in the addition of 0 wt % to 0.02 wt % boron. The amount of titanium added from introducing the grain refiner is discussed below.

The amount of each compositional component that can be used in the disclosed aluminum alloy compositions is described. In some embodiments, the amount of copper present in the compositions can range from 3 wt % to 8 wt %, such as 3.5 wt % to 7.5 wt %, or 4 wt % to 7 wt %, or 4.5 wt % to 6.5 wt %, or 5 wt % to 6 wt %, or 5.5 wt % to 8 wt %. In particular disclosed embodiments, the amount of copper present in the aluminum alloy composition can be selected from 3 wt %, 3.5 wt %, 4 wt %, 4.5 wt %, 5 wt %, 5.5 wt %, 6 wt %, 6.5 wt %, 7 wt %, 7.5 wt %, or 8 wt %. In some embodiments, the amount of zirconium present in the compositions can range from 0.05 wt % to 0.3 wt %, such as 0.05 wt % to 0.2 wt %, or 0.05 wt % to 0.15 wt %. In particular disclosed embodiments, the amount of zirconium present in the compositions can be selected from 0.05 wt %, less than 0.07 wt %, 0.1 wt %, 0.15 wt %, 0.2 wt %, 0.25 wt %, or 0.3 wt %. In some embodiments, the amount of titanium present in the compositions can range from 0 wt % to 0.3 wt %, such as greater than 0 wt % to 0.3 wt %, or greater than 0 wt % to less than 0.3 wt %, or greater than 0 wt % to less than 0.2 wt %, or greater than 0 wt % to 0.15 wt %, or greater than 0 wt % to 0.1 wt %, or greater than 0 wt % to 0.05 wt %. In particular disclosed embodiments, the amount of titanium present in the compositions can be selected from 0.2 wt %, 0.15 wt %, 0.1 wt %, or 0.05 wt %. In some embodiments, the amount of manganese present in the compositions can range from 0.05 wt % to 1 wt %, such as 0.1 wt % to 0.75 wt %, 0.2 wt % to 0.5 wt %, or 0.2 wt % to 0.48 wt %, or 0.3 wt % to 0.4 wt %, or 0.1 wt % to 0.3 wt %, or 0.05 wt % to less than 0.2 wt %. In particular disclosed embodiments, the amount of manganese present in the compositions can be selected from 0.05 wt %, 0.1 wt %, less than 0.2 wt %, 0.2 wt %, 0.3 wt %, 0.5 wt %, or 0.75 wt %. In some embodiments, the amount of silicon present in the compositions can range from 0 wt % to 0.2 wt %, such as greater than 0 wt % to less than 0.2 wt %, or greater than 0 wt % to 0.15 wt %, or 0.01 wt % to 0.1 wt %, or 0.01 wt % to 0.05 wt %, or 0.01 wt % to 0.05 wt %, or 0.01 wt % to 0.04 wt %, or 0.01 wt % to 0.03 wt %, or 0.01 wt % to 0.02 wt %. In particular disclosed embodiments, the amount of silicon present in the compositions can be selected from 0 wt %, 0.01 wt %, 0.02 wt %, 0.03 wt %, 0.04 wt %, 0.05 wt %, 0.06 wt %, 0.07 wt %, 0.08 wt %, 0.09 wt %, or 0.1 wt %. In some embodiments, the amount of iron present in the compositions can range from 0 wt % to 0.2 wt %, such as greater than 0 wt % to less than 0.2 wt %, or greater than 0 wt % to 0.15 wt %, or greater than 0 wt % to 0.1 wt %, or greater than 0 wt % to 0.05 wt %, or 0.05 wt % to less than 0.2 wt %. In particular disclosed embodiments, the amount of iron present in the compositions can be selected from 0.2 wt %, 0.15 wt %, 0.1 wt %, or 0.05 wt %. In some embodiments, the amount of nickel present in the compositions can range from 0 wt % to 0.01 wt %, such as greater than 0 wt % to less than 0.01 wt %, or greater than 0 wt % to 0.0075 wt %, or greater than 0 wt % to 0.005 wt %, or greater than 0 wt % to 0.0025 wt %, or 0.0025 wt % to less than 0.01 wt %. In particular disclosed embodiments, the amount of nickel present in the compositions can be selected from 0 wt %, 0.0025 wt %, 0.005 wt %, 0.0075 wt %, or 0.01 wt %. In some embodiments, the amount of magnesium present in the compositions can range from 0 wt % to 0.01 wt %, such as greater than 0 wt % to less than 0.01 wt %, or greater than 0 wt % to 0.0075 wt %, or greater than 0 wt % to 0.005 wt %, or greater than 0 wt % to 0.0025 wt %, or 0.0025 wt % to less than 0.01 wt %. In particular disclosed embodiments, the amount of magnesium present in the compositions can be selected from 0 wt %, 0.0025 wt %, 0.005 wt %, 0.0075 wt %, or 0.01 wt %. In some embodiments, the amount of cobalt present in the compositions can range from 0 wt % to 0.1 wt %, such as greater than 0 wt % to less than 0.1 wt %, or greater than 0 wt % to 0.08 wt %, or 0.01 wt % to 0.07 wt %, or 0.01 wt % to 0.06 wt %, or 0.01 wt % to 0.05 wt %, or 0.01 wt % to 0.04 wt %, or 0.01 wt % to 0.03 wt %, or 0.01 wt % to 0.02 wt %. In particular disclosed embodiments, the amount of cobalt present in the compositions can be selected from 0 wt %, 0.01 wt %, 0.02 wt %, 0.03 wt %, 0.04 wt %, 0.05 wt %, 0.06 wt %, 0.07 wt %, 0.08 wt %, 0.09 wt %, or 0.1 wt %. In some embodiments, the amount of antimony present in the compositions can range from 0 wt % to 0.1 wt %, such as greater than 0 wt % to less than 0.1 wt %, or greater than 0 wt % to 0.08 wt %, or 0.01 wt % to 0.07 wt %, or 0.01 wt % to 0.06 wt %, or 0.01 wt % to 0.05 wt %, or 0.01 wt % to 0.04 wt %, or 0.01 wt % to 0.03 wt %, or 0.01 wt % to 0.02 wt %. In particular disclosed embodiments, the amount of antimony present in the compositions can be selected from 0 wt %, 0.01 wt %, 0.02 wt %, 0.03 wt %, 0.04 wt %, 0.05 wt %, 0.06 wt %, 0.07 wt %, 0.08 wt %, 0.09 wt %, or 0.1 wt %. The amount of aluminum present in the composition can range from 80 wt % to 98 wt %, such as 80 wt % to 95 wt %, or 85 wt % to 92 wt %, or 90 wt % to 92 wt %, or 85 wt % to 93 wt %. In particular disclosed embodiments, the amount of aluminum present in the compositions is the balance (or remainder) wt % needed to achieve 100 wt % with other components, and in such embodiments, there may be unavoidable impurities present in the composition, wherein the total content of impurities amounts to no more than 0.2 wt %, such as 0 to 0.15 wt %, or 0 to 0.1 wt %, or 0 to 0.5 wt %.

In particular disclosed embodiments, the amount of manganese present in the aluminum alloy compositions is greater than that of the amount of iron present, the amount of zirconium present is greater than that of the amount of titanium, or both such conditions apply. In yet additional embodiments, the amount of manganese present in the aluminum alloy compositions is greater than the amount of silicon present, with particular disclosed embodiments having manganese present in an amount greater than 3 times the amount of silicon present. In particular disclosed embodiments, the amount of silicon included in the alloy is kept to a minimum, with certain embodiments having amounts of silicon lower than 0.2 wt %, such as less than 0.1 wt %, or less than 0.08 wt % or less than 0.05 wt %. The amount of silicon present in the compositions is typically minimized so as to avoid poisoning the semi-coherent interface. Higher amounts lead to the formation of the thermodynamically stable phase that can coarsen rapidly leading to a rapid loss in mechanical properties. Si content should be <0.1 wt % for best results. In additional embodiments, the amount of magnesium present in the compositions is kept to a minimum. Magnesium, particularly in combination with silicon, is a fast diffusing element that can rapidly partition to the strengthening precipitate and not allow the effective alloying elements, such as manganese and zirconium, to invoke temperature stabilization. Other elements that can constitute impurities include, but are not limited to, iron, cobalt, nickel, and antimony. Iron typically should be maintained below a level of 0.2 wt % to avoid forming intermetallics, which can have a detrimental effect on the hot tearing resistance of the disclosed compositions.

Particular disclosed aluminum alloy compositions comprise 3 wt % to 8 wt % copper, 0.1 wt % to 0.3 wt % zirconium, less than 0.2 wt % titanium (before addition of a grain refiner), 0.1 wt % to 0.48 wt % manganese, and the remainder being aluminum. Such embodiments can further comprise less than 0.1 wt % silicon, less than 0.2 wt % iron, less than 0.01 wt % nickel, less than 0.01 wt % magnesium, less than 0.1 wt % cobalt, less than 0.1 wt % antimony, or any combination thereof. In some embodiments, the aluminum alloy compositions can comprise an amount of manganese that is greater than ((0.08*copper (in wt %))−0.14) and the amount of zirconium can be greater than ((0.04*copper (in wt %))−0.08), and wherein the amount of copper ranges from 6-8 wt % and the amount of silicon is less than 0.1 wt %. In some embodiments, the aluminum alloy compositions can comprise manganese in an amount satisfying the formula ((0.04*copper (in wt %))−0.02) where copper ranges from 3 wt % to 8 wt % and the zirconium can be present in an amount satisfying the formula ((0.02*copper (in wt %))−0.01) where copper ranges from 3 wt % to 8 wt %. Such embodiments are particularly suited for providing alloys exhibiting reduced hot tearing susceptibility and/or superior elevated temperature mechanical properties as compared to conventional alloys.

In exemplary embodiments, the aluminum alloy composition comprises, consist essentially of, or consists of 6.5 wt % copper, 0.2 wt % manganese, 0.15 wt % zirconium, 0.1 wt % titanium, less than 0.2 wt % silicon, less than 0.2 wt % iron, less than 0.01 wt % nickel, less than 0.01 wt % magnesium, less than 0.1 wt % cobalt, less than 0.1 wt % antimony, with aluminum making up the balance, along with 0 wt % to 0.2 wt % unavoidable impurities. In other exemplary embodiments, the aluminum alloy compositions can comprise, consist essentially of, or consist of 6.6 wt % copper, 0.48 wt % manganese, 0.18 wt % zirconium, 0.01 wt % titanium, less than 0.2 wt % silicon, less than 0.2 wt % iron, less than 0.01 wt % nickel, less than 0.01 wt % magnesium, less than 0.1 wt % cobalt, less than 0.1 wt % antimony, with aluminum making up the balance, along with 0 wt % to 0.2 wt % unavoidable impurities. In yet other exemplary embodiments, the aluminum alloy compositions can comprise, consist essentially of, or consist of 6.6 wt % copper, 0.48 wt % manganese, 0.18 wt % zirconium, 0.03 wt % titanium, less than 0.2 wt % silicon, less than 0.2 wt % iron, less than 0.01 wt % nickel, less than 0.01 wt % magnesium, less than 0.1 wt % cobalt, less than 0.1 wt % antimony, with aluminum making up the balance, along with 0 wt % to 0.2 wt % unavoidable impurities. In yet other exemplary embodiments, the aluminum alloy compositions can comprise, consist essentially of, or consist of 6.6 wt % copper, 0.48 wt % manganese, 0.18 wt % zirconium, 0.11 wt % titanium, less than 0.2 wt % silicon, less than 0.2 wt % iron, less than 0.01 wt % nickel, less than 0.01 wt % magnesium, less than 0.1 wt % cobalt, less than 0.1 wt % antimony, with aluminum making up the balance, along with 0 wt % to 0.2 wt % unavoidable impurities. In yet other exemplary embodiments, the aluminum alloy compositions can comprise, consist essentially of, or consist of 6.6 wt % copper, 0.48 wt % manganese, 0.18 wt % zirconium, 0.21 wt % titanium, less than 0.2 wt % silicon, less than 0.2 wt % iron, less than 0.01 wt % nickel, less than 0.01 wt % magnesium, less than 0.1 wt % cobalt, less than 0.1 wt % antimony, with aluminum making up the balance, along with 0 wt % to 0.2 wt % unavoidable impurities. In yet other exemplary embodiments, the aluminum alloy compositions can comprise, consist essentially of, or consist of 6.5 wt % copper, 0.1 wt % to less than 0.2 wt % manganese, 0.15 wt % zirconium, greater than 0.2 wt % and up to 0.3 wt % titanium, and 85-93 wt % aluminum.

In some embodiments, the amount of each component present in the alloy can vary based on the portion of the casting analyzed with, for example, inductively coupled plasma optical emission spectrometry and inductively coupled plasma mass spectrometry. In some embodiments, the alloy casting can comprise an amount of each component matching those described above. In yet additional embodiments, different portions (e.g., an outer surface of a casting, an inner portion of the casting, and the like) of a casting can comprise an amount of each component that substantially matches the amounts described above, wherein "substantially matches" means that the amount of the particular component within the alloy ranges from 80% to 110% of the amounts disclosed herein, such as 85% to 105%, or 90% to 99%, or 90% to 95%.

The aluminum alloy compositions disclosed herein can comprise additional components, such as grain refiners, which can include master alloys. In particular disclosed embodiments, the amount of grain refiner included in the composition can be greater than, such as one order of magnitude greater than, the amount of grain refiner used in conventional compositions. In some embodiments, the amount of grain refiner included with the compositions can be selected based on a target weight percent of titanium that is to be added to the composition by introduction of the grain refiner. In such embodiments, the desired amount of additional titanium that is to be added to the composition is identified and then the amount of the master alloy to be added (typically in kgs) to a specific metal volume to increase the titanium amount by the additional amount is calculated. In particular disclosed embodiments, the amount of the grain refiner that is added can vary with the type of master alloy used.

As indicated above, the grain refiner can contribute to the amount of titanium present in the alloy compositions. For example, using a grain refiner can result in the composition comprising an additional amount of titanium, such as from 0.02 wt % to 0.2 wt % additional Ti, or from 0.02 wt % to 0.15 wt % additional Ti, or from 0.02 wt % to 0.1 wt % additional Ti. In particular disclosed embodiments, the amount of additional Ti introduced by adding a grain refiner can be 0.02 wt %, 0.1 wt %, or 0.2 wt %. Suitable grain refiners include, but are not limited to grain refiners that facilitate nucleation of new grains of aluminum. Some grain refiners can include, but are not limited to, grain refiners comprising aluminum, titanium, boron, and combinations thereof, which can include master alloys. In particular disclosed embodiments, the grain refiner can be a TiBor master alloy grain refiner, which is a grain refiner comprising a combination of aluminum, titanium, and boron. The grain refiner can comprise titanium in an amount ranging from 2 wt % to 6 wt %, such as 3 wt % to 6 wt %, or 3 wt % to 5 wt %; boron in an amount ranging from 0.5 wt % to 2 wt %, such as 0.5 wt % to 1 wt %, or 0.75 wt % to 1 wt %; and aluminum making up the remainder wt %; and any combination thereof. In exemplary embodiments, the TiBor grain refiner comprises 94 wt % aluminum, 5 wt % titanium, and 1 wt % boron, or 96 wt % aluminum, 3 wt % titanium, and 1 wt % boron. Other grain refiners known in the art can be used in combination with the alloy compositions disclosed herein. In particular disclosed embodiments, grain refiners can be used to improve the hot tear resistance of the cast aluminum alloy compositions. In particular disclosed embodiments, the hot tear resistance of the cast aluminum alloy compositions can be further improved by using the grain refiners in combination with alloy composition embodiments comprising 6 wt % to 8 wt % copper.

Figure 2:
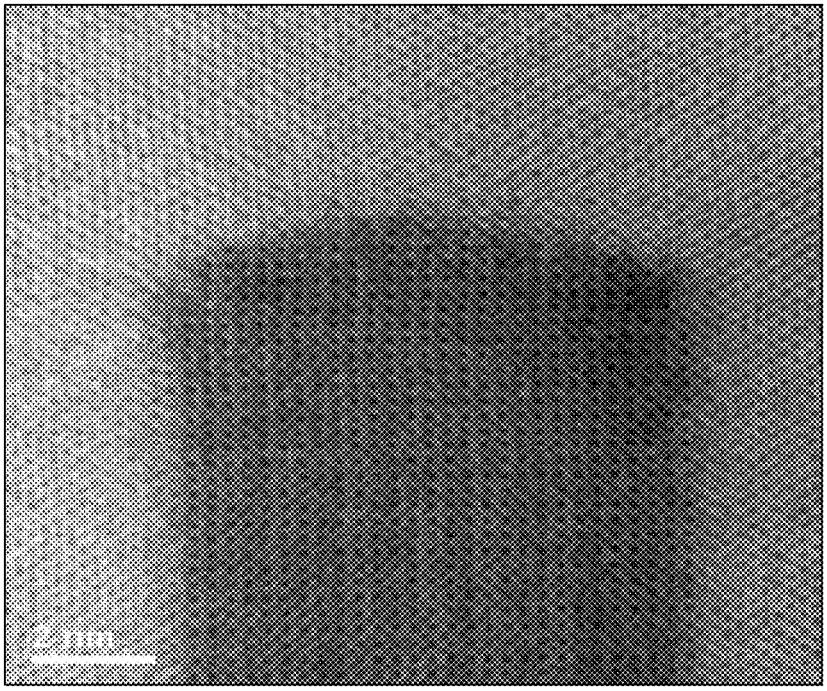
FIG. 2 is an HRTEM image showing the coherency of the long axis of the θ' precipitate platelet shown in FIG. 1 with the matrix.

In contrast to conventional alloy compositions, which incorporate fine strengthening precipitates, the aluminum alloy compositions described herein comprise coarse strengthening precipitates that remain stable and coherent with the matrix at high temperatures, such as temperatures above 250° C. (e.g., 350° C.). Unlike fine strengthening precipitate alloy compositions that exhibit good mechanical properties at lower temperature but that coarsen rapidly at temperatures above 250° C. and lose their coherency with the matrix, the disclosed alloy compositions are able to perform and remain stable at temperatures well above 250° C. Without being limited to a single theory of operation, it is currently believed that the elevated temperature microstructural stability of the disclosed aluminum alloys is the selective microsegregation of alloying elements in the bulk as well as coherent/semi-coherent interfaces of θ' precipitates. It is also currently believed that this microsegregation can "freeze" the precipitates into low energy states that renders them exceptionally stable to thermal exposure at high temperatures, such as temperatures between 250° C. to 350° C., or higher. High resolution transmission electron microscopic (HRTEM) images of the coarse θ' type precipitate in a representative alloy that is relatively coherent with the aluminum matrix (both along precipitate rims and faces) are shown in FIGS. 1 and 2. In particular disclosed embodiments, the microstructural stability exhibited by the disclosed alloy compositions can be obtained by reducing the amount of silicon present in the alloy to an amount less than 0.1 wt % of the composition. The structural characteristics of the aluminum alloys disclosed herein can be evaluated by determining the presence of coarse but high aspect ratio strengthening precipitates of the disclosed alloys using, for example, TEM analysis, HRTEM analysis, SEM analysis, or a combination thereof. In yet additional embodiments, a composition can be evaluated using inductively coupled plasma mass spectrometry to determine the amount and identity of the compositional components present in a constructed alloy-containing product. In some embodiments, the alloy compositions exhibit precipitates having diameters ranging from 100 nm to 1.2 μm and a thickness ranging from 5 nm to 30 nm, such as 8 nm to 10 nm. In particular disclosed embodiments, the thickness should not be higher than 40-50 nm. In some additional embodiments, the aspect ratio of the precipitates of the alloy compositions can range from 30 to 40.

Figure 3:
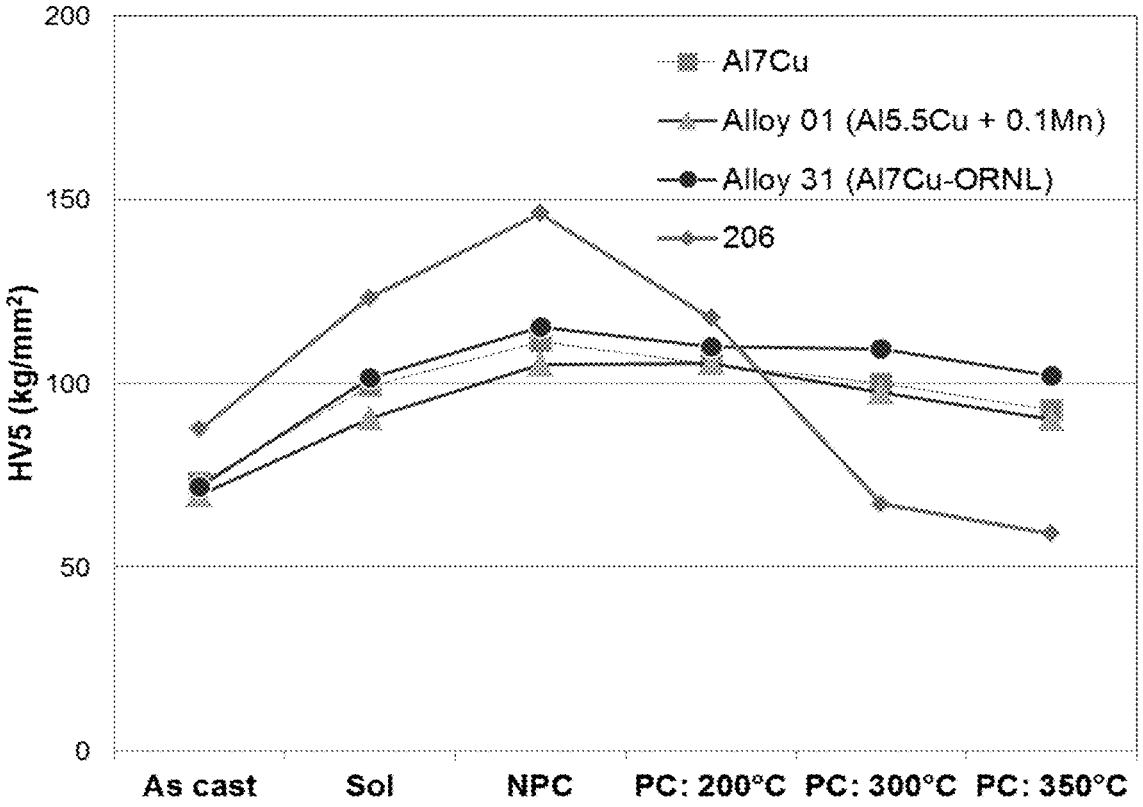
FIG. 3 is a graph of Vickers Hardness at 5 kg load ("HV5") as a function of different heat treatments, which illustrates the stability of the microstructure of various alloys ("■" represents an inventive alloy comprising, in part, 6.5 wt % copper, 0.5 wt % manganese, and aluminum; "●" represents an inventive alloy comprising, in part, 5.5 wt % copper, 0.1 wt % manganese, and aluminum; "▲" represents an inventive alloy comprising, in part, 7 wt % copper and aluminum; and "◆" represents a 206-type commercial Al-5Cu alloy).

The exceptional high temperature stability of a representative microstructure is illustrated in FIG. 3. Room temperature Vickers Hardness (at 5 kg load) for four different alloy embodiments is plotted as a function of the different heat treatments: (1) as cast; (2) solutionized; (3) aged; and (4) preconditioning (PC) treatment. Preconditioning (with reference to FIG. 2) includes a 200 hour heat treatment of the alloy after the ageing treatment and data is included for PC treatment at 200° C., 300° C., and 350° C. Data obtained from analysis of three representative alloys and one comparative alloy are shown in FIG. 3 ("■" represents an inventive alloy comprising, in part, 6.5 wt % copper, 0.5 wt % manganese, and aluminum; "●" represents an inventive alloy comprising, in part, 5.5 wt % copper, 0.1 wt % manganese, and aluminum; "▲" represents an inventive alloy comprising, in part, 7 wt % copper and aluminum; and "◆" represents a 206-type commercial Al-5Cu alloy). The exceptional elevated temperature response of the representative inventive alloys is clearly observed through their nearly horizontal response up to 350° C. compared to the 206-type commercial alloy. Additional results are shown in FIGS. 19-22, which are described in more detail below.

As can be seen in FIGS. 1 and 2, once a minimum critical size is exceeded in the platelets during growth (a size which is targeted by design of both composition and heat treatment), the precipitates exhibit minimum coarsening. The short axis in FIG. 2, which is the primary growth front for the platelets, is semi-coherent and low mobility when the appropriate elements microsegregate to this interface. Also, as can be seen in FIG. 3, while the mechanical properties of the 206-type alloy exceed those of the representative inventive alloys up to 200° C., due to the presence of the typically-targeted fine strengthening precipitates, the 206-type alloy's mechanical strength decreases rapidly at temperatures higher than 200° C. These results corroborate that the fine strengthening precipitates of the 206-type alloy are not stable and thus coarsen rapidly above 200° C., whereas the representative inventive alloys maintain their mechanical strength at temperatures above 200° C.

Figure 4A:
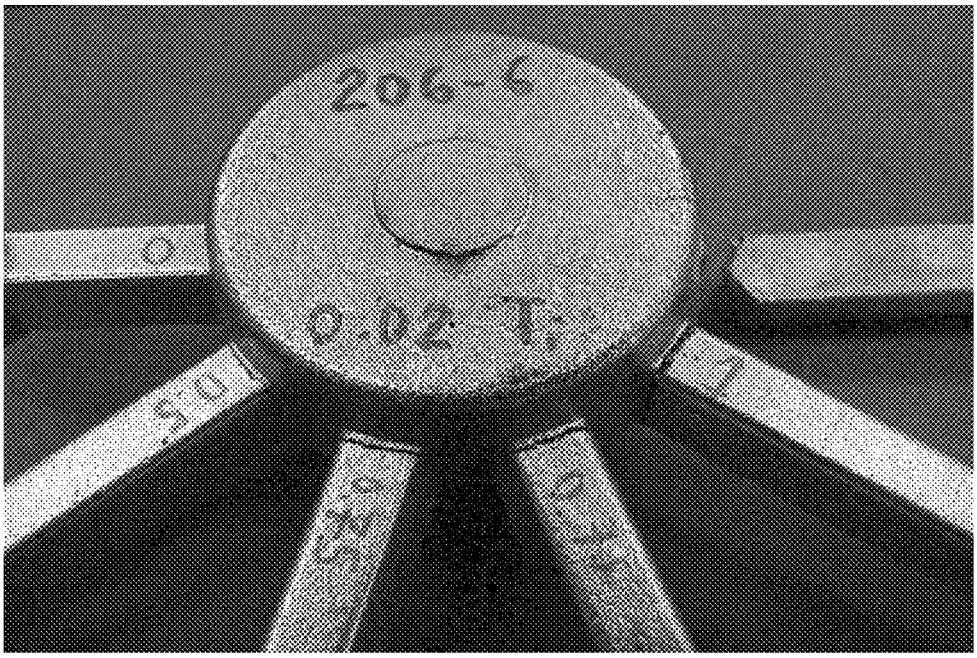
FIGS. 4A and 4B are a photographic image of representative castings used to evaluate hot tearing susceptibility of compositions described herein.
Figure 4B:
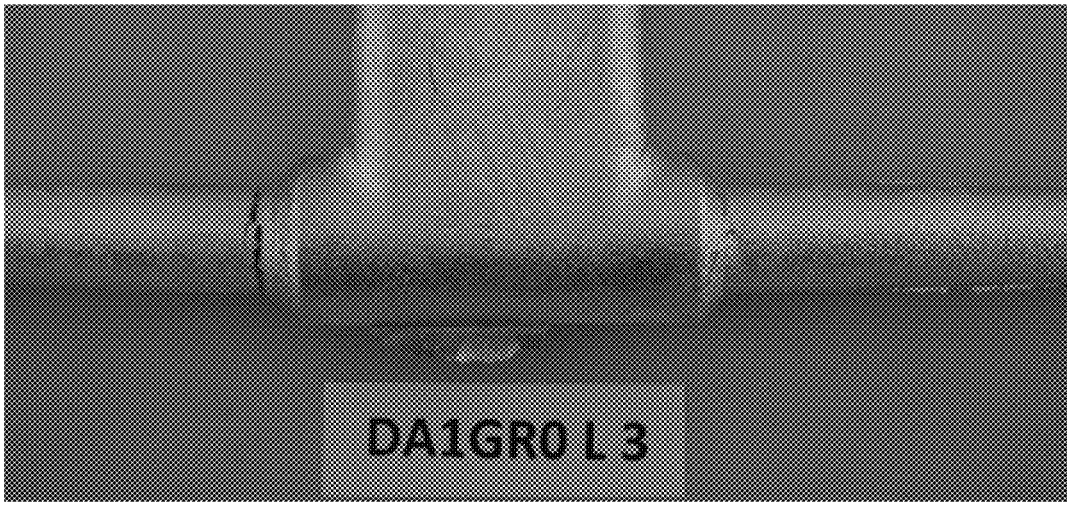

Aluminum alloy compositions disclosed herein also exhibit improved hot tearing susceptibility as compared to other aluminum alloy compositions, such as 206-type alloys, 319 alloys, 356 alloys, and RR350 alloys. In particular disclosed embodiments, the hot tearing susceptibility of an alloy composition, as described herein, can be measured by making a plurality of castings of an aluminum alloy composition in a particular shape, such as that illustrated in FIG. 4A. After each test, the casting is examined and assigned a hot tearing rating number defining the extent of tearing observed. In some embodiments, the hot tearing rating number can be a numerical value between 0 and 1 and the following assignment scheme can be used: 1 point for a fully broken piece of the casted component; 0.75 points for a severe tear (a piece of the casted component fully cracked but still strongly attached to the remainder of the cast component); 0.5 points for a visible tear (a piece of the casted component that is not fully cracked); 0.25 points for a tear detectable only under 5× to 10× magnification; and 0.0 points when no cracks are present under 5× to 10× magnification. The hot tearing rating number for each piece of the casted component is summed to provide a total hot tearing value for each casting. A particular number of castings can be poured for each alloy composition to be evaluated, such as 3 to 10 castings, or 3 to 8 castings, or 3 to 5 castings. A total hot tearing value is calculated for each casting and the average rating can be calculated. A lower number, according to this type of evaluation scheme, indicates lower susceptibility to hot tearing (thus indicating resistance to hot tearing). In some embodiments, hot tearing susceptibility can depend on the shape of the alloy casting begin tested. In particular disclosed embodiments, an average hot tearing value of 1.5 to 2.5 can correspond to a desirable hot tearing susceptibility, such as 1.5 to 2.25, or 1.5 to 2. The hot tearing values exhibited by aluminum alloy compositions described herein are lower than those for an industry standard alloy, such as 319 alloys, which exhibits hot tearing values greater than 2.5 in the same test.

IV. Methods of Making Compositions

The aluminum alloy compositions described herein can be made according to the following methods. In particular disclosed embodiments, the aluminum alloy compositions described herein can be made by combining cast aluminum alloy precursors with pre-melted alloys that provide high melting point elements. The cast aluminum alloy precursors are melted inside a reaction vessel (e.g., graphite crucible or large-scale vessel). The pre-melted alloys are prepared by arc-melting in advance. The reaction vessel is retained inside a box furnace at, for example, 775° C., with Ar cover gas for a suitable period of time (e.g., 30 minutes or longer). The melted Al alloys are then poured into a steel mold pre-heated at 300° C. Prior to the pouring, the molten metal inside the crucible is stirred by using a graphite rod pre-heated at 300° C., to verify that all elements or pre-melted alloys were fully dissolved into the liquid. Heat treatments such as solution annealing, aging, and pre-conditioning can be applied to the cast Al alloys inside a box furnace in laboratory air. The temperature can be monitored by a thermo-couple attached to the material surface. Vickers hardness of the heat-treated materials can be measured on the cross-sectional surface at 5 kg load. The average hardness data obtained from 10 indents can be used as a representative of each annealing condition. The method steps described above are scalable and therefore are suitable for industrial scale methods.

In some embodiments, the methods can include heating the compositional components under a solution heat treatment procedure at a temperature ranging from 525° C. to 540° C. Before casting, the composition can be aged at a temperature ranging from 210° C. to 250° C. In some embodiments, the composition can undergo aging treatment at temperatures lower than 210° C., such as 175° C. to 190° C. In such embodiments, this lower aging treatment temperature can be used to improve low temperature strength (that is, at temperatures lower than 150° C.) of the cast composition.

V. Methods of Use

The aluminum alloy compositions disclosed herein can be used in applications using cast aluminum compositions. The aluminum alloy compositions are suitable for use in myriad components requiring cast aluminum alloy structures, with exemplary embodiments including, but not being limited to, automotive powertrain components (such as engine cylinder heads, blocks, water cooled turbocharger manifolds, and other automotive components), aerospace components, heat exchanger components, or other components requiring stable aluminum-containing compounds at high temperatures. In particular disclosed embodiments, the disclosed aluminum alloy compositions can be used to make cylinder heads or engine blocks for internal combustion engines and are particularly useful for components having ornamental shapes or details.

VI. Examples

In some examples, cast Al alloys with nominal weight of 270 g were melted inside a graphite crucible by using pure element feedstock together with pre-melted alloys for high melting point elements. The pre-melted alloys were prepared by arc-melting in advance. The graphite crucible was kept inside a box furnace at 775° C. with Ar cover gas for more than 30 minutes. The melted Al alloys were then poured into a steel mold pre-heated at 300° C. with a size of 25×25×150 mm. Prior to the pouring, the molten metal inside the crucible was stirred by using a graphite rod pre-heated at 300° C., to verify that all elements or pre-melted alloys were fully dissolved into the liquid. Heat treatments such as solution annealing, aging, and pre-conditioning were applied to the cast Al alloys inside a box furnace in laboratory air. The temperature was monitored by a thermo-couple attached to the material surface. Vickers hardness of the heat-treated materials was measured on the cross-sectional surface at 5 kg load. The average hardness data obtained from 10 indents was used as a representative of each annealing condition.

A comparison of the compositional components of an exemplary alloy with other compositions is provided by Table 1.

TABLE 1

Comparison of Compositional Components

| Element (wt %) | Inventive Composition (wt %) | RR350 alloy (wt %)[a] | 224 alloy (wt %)[b] |
|---|---|---|---|
| Cu | 3.0-8.0 | 5 | 3.6 |
| Zr | 0.1-0.3 | 0.2 | 0.15 |
| Ti | <0.2 | 0.2 | 0.23 |
| Mn | 0.1-0.3 | 0.2 | 0.3 |
| Si | <0.1 | ≤0.25 | 0.07 |
| Fe | <0.2 | ≤1.5 | 0.1 |
| Ni | <0.01 | 1.5 | — |
| Mg | <0.01 | <0.2 | 0.35 |
| Co | <0.1 | 0.25 | — |
| Sb | <0.1 | 0.15 | — |
| V | — | — | 0.14 |
| Al | Balance | Balance | Balance |

[a]as disclosed in U.S. Pat. No. 2,781,263

[b]as disclosed in Modern Casting, March 2015, pages 45-50

Results from a comparison of mechanical properties of the above exemplary alloy and other alloys are provided by Table 2.

TABLE 2

Comparison of Compositional Properties

| Property | Inventive Composition[a] | RR350 alloy[b] | 224 alloy[b] |
|---|---|---|---|
| 0.2% Yield Strength @RT (MPa) | 200 | 171 | 317 |
| UTS @RT (MPa) | 356 | 286 | 384 |
| 0.2% Yield Strength @ 300° C. (MPa) | 105 | 98 | 122 |
| UTS @ 300° C. (MPa) | 134 | 124 | 139 |

[a]Composition for this inventive embodiment corresponds to Al—6.5Cu—0.2Mn—0.15Zr—0.10Ti

[b]Composition for the properties in this table corresponds to Al—5Cu—1.5Ni—0.25Co—0.20Zr—0.20Ti—0.15Sb—0.20Mn as disclosed by U.S. Pat. No. 2,781,263

[c]Soak time at 300° C. was 100 hr compared to 200 hr for the other alloys. Composition that showed best mechanical properties (in the table) was 224.0 + VZrMg0.35Cu3.6_T7, as disclosed in Modern Casting, March 2015, pages 45-50

Results from additional embodiments are illustrated in FIGS. 19-22, which provide stability results obtained from analyzing various alloys using a Vickers hardness test. The data for the embodiments illustrated graphically in FIGS. 19-22 also are presented in Tables 3-6 below. Table 7 provides the components and the amounts of each component included in the alloy compositions, along with, for certain embodiments, the amounts of the components detected in different portions of the alloy casting (e.g., top, bottom, and middle of a rectangular-shaped casting).

TABLE 3

| | As cast | Sol | NPC | PC: 200° C. | PC: 300° C. | PC: 350° C. |
|---|---|---|---|---|---|---|
| Al7Cu | 73.0 | 99.2 | 111.4 | 105.1 | 100.1 | 92.7 |
| RR350 | 70.2 | 86.1 | 95.6 | 88.8 | 89.9 | 83.1 |
| 206 | 87.6 | 123.3 | 146.2 | 117.8 | 67.1 | 59.1 |
| Alloy 01 | 69.5 | 90.5 | 105.1 | 105.4 | 97.5 | 90.1 |
| Alloy 02 | 65.5 | 80.7 | 117.3 | 106.2 | 95.1 | 56.8 |
| Alloy 03 | 56.3 | 82.8 | 126.5 | 104.1 | 49.2 | 52.5 |
| Alloy 20 | 100.8 | 122.5 | 158.0 | 142.3 | 90.7 | 77.4 |

TABLE 4

| | As cast | Sol | NPC | PC: 200° C. | PC: 300° C. | PC: 350° C. |
|---|---|---|---|---|---|---|
| Al7Cu | 73.0 | 99.2 | 111.4 | 105.1 | 100.1 | 92.7 |
| RR350 | 70.2 | 86.1 | 95.6 | 88.8 | 89.9 | 83.1 |
| 206 | 87.6 | 123.3 | 146.2 | 117.8 | 67.1 | 59.1 |
| Alloy 31 | 71.8 | 101.5 | 115.3 | 109.9 | 109.5 | 101.9 |
| Alloy 33 | 88.0 | 126.1 | 152.2 | 132.9 | 69.1 | 57 |
| Alloy 46 | 73.5 | 106.8 | 125.9 | 115.8 | 109.9 | 98.4 |
| Alloy 50 | 107.1 | 139.6 | 162.5 | 140.6 | 91.4 | 73.7 |

TABLE 5

| | As cast | Sol | NPC | PC: 200° C. | PC: 300° C. | PC: 350° C. |
|---|---|---|---|---|---|---|
| Al7Cu | 73.0 | 99.2 | 111.4 | 105.1 | 100.1 | 92.7 |
| RR350 | 70.2 | 86.1 | 95.6 | 88.8 | 89.9 | 83.1 |
| 206 | 87.6 | 123.3 | 146.2 | 117.8 | 67.1 | 59.1 |
| Alloy 4 | 75.2 | 94.8 | 103.2 | 109.36 | 101.1 | 91.01 |
| Alloy 5 | 70.2 | 88.9 | 106.22 | 102.64 | 65.15 | 58.61 |
| Alloy 6 | 70.5 | 95.7 | 102.0 | 106.79 | 93.95 | 64.46 |
| Alloy 17 | 74.8 | 94.5 | 116.0 | 101.34 | 77.43 | 57.23 |
| Alloy 18 | 101.1 | 129.6 | 171.3 | 147.53 | 85.02 | 56.33 |

TABLE 6

| | As cast | Sol | NPC | PC: 200° C. | PC: 300° C. | PC: 350° C. |
|---|---|---|---|---|---|---|
| Al7Cu | 73.0 | 99.2 | 111.4 | 105.1 | 100.1 | 92.7 |
| RR350 | 70.2 | 86.1 | 95.6 | 88.8 | 89.9 | 83.1 |
| 206 | 87.6 | 123.3 | 146.2 | 117.8 | 67.1 | 59.1 |
| Alloy 23 | 100.2 | 119.5 | 113.3 | 101.82 | 65.26 | 65.64 |
| Alloy 51 | 55.9 | 63.8 | 72.7 | 75.69 | 68.6 | 65.32 |

TABLE 6-continued

| | As cast | Sol | NPC | PC: 200° C. | PC: 300° C. | PC: 350° C. |
|---|---|---|---|---|---|---|
| Alloy 52 | 60.2 | 72.9 | 84.1 | 85.41 | 78.03 | 72.84 |
| Alloy 53 | 68.4 | 86.8 | 100.8 | 100.75 | 95.6 | 80.56 |
| Alloy 54 | 75.0 | 104.6 | 114.3 | 106.85 | 109.35 | 79.55 |
| Master alloy 2 | 58.16 | 96.06 | 99.12 | 81.58 | 52.56 | 41.92 |

TABLE 7

| | COMPOSITION, WT % | | | | | | | | | | | | |
|---|---|---|---|---|---|---|---|---|---|---|---|---|---|
| ALLOY | Si | Cu | Mg | Zn | Fe | Ni | Mn | Co | Zr | Ti | V | Sb | Al |
| Al7Cu-T6 | 0.005 | 6.403 | 0.002 | 0.042 | 0.096 | 0.010 | 0.189 | <0.002 | 0.134 | 0.086 | 0.005 | <0.0001 | 93.408 |
| #01 | 0.04 | 6.50 | — | 0.05 | 0.10 | — | 0.20 | — | 0.165 | 0.10 | — | — | 92.84 |
| top | 0.037 | 5.508 | <0.001 | 0.087 | 0.076 | 0.005 | 0.104 | <0.001 | 0.165 | 0.004 | 0.006 | <0.001 | Rem. |
| bottom | 0.038 | 5.367 | <0.001 | 0.085 | 0.084 | 0.005 | 0.105 | <0.001 | 0.165 | 0.004 | 0.006 | <0.001 | Rem. |
| #02 | 0.04 | 5.04 | — | — | 0.10 | 1.50 | 0.20 | 0.25 | 0.165 | 0.20 | — | 0.15 | 92.35 |
| top | 0.04 | 4.968 | <0.001 | 0.007 | 0.079 | 0.147 | 0.108 | 0.016 | 0.159 | 0.004 | 0.006 | 0.067 | Rem. |
| bottom | 0.042 | 5.043 | <0.001 | 0.004 | 0.082 | 0.145 | 0.108 | 0.016 | 0.156 | 0.004 | 0.006 | 0.071 | Rem. |
| #03 | 0.20 | 5.20 | 0.40 | — | 0.20 | — | 0.20 | — | 0.002 | — | — | — | 94.00 |
| top | 0.15 | 4.68 | 0.01 | 0.004 | 0.068 | 0.004 | 0.001 | <0.001 | 0.004 | 0.004 | 0.006 | <0.001 | Rem. |
| bottom | 0.167 | 4.939 | 0.01 | 0.004 | 0.075 | 0.005 | <0.001 | <0.001 | 0.003 | 0.004 | 0.006 | <0.001 | Rem. |
| #4 | 0.04 | 6.50 | — | 0.05 | 0.10 | — | 0.40 | — | 0.165 | 0.10 | — | — | 92.64 |
| middle | 0.047 | 6.54 | <0.002 | 0.008 | 0.118 | 0.008 | 0.512 | <0.0020 | 0.167 | 0.091 | 0.012 | <0.0001 | 92.49 |
| #5 | 0.04 | 6.50 | — | 0.05 | 0.10 | — | 0 | — | 0.165 | 0.10 | — | — | 93.04 |
| middle | 0.046 | 6.25 | <0.002 | 0.008 | 0.109 | 0.005 | <0.002 | <0.0020 | 0.134 | 0.080 | 0.011 | <0.0001 | 93.35 |
| #6 | 0.04 | 6.50 | — | 0.05 | 0.10 | — | 0.20 | — | 0.002 | 0.30 | — | — | 92.80 |
| middle | 0.047 | 6.29 | <0.002 | 0.012 | 0.111 | 0.005 | 0.194 | <0.0020 | 0.005 | 0.210 | 0.012 | <0.0001 | 93.1 |
| #16 | 0.04 | 6.50 | — | — | 0.10 | 0 | 0.20 | 0.25 | 0.165 | 0.10 | 0.10 | 0.15 | 92.39 |
| top | 0.036 | 5.077 | <0.001 | 0.005 | 0.064 | 0.006 | 0.101 | 0.001 | 0.17 | 0.005 | 0.006 | 0.074 | Rem. |
| bottom | 0.043 | 5.754 | <0.001 | 0.004 | 0.076 | 0.005 | 0.103 | 0.001 | 0.17 | 0.005 | 0.006 | 0.083 | Rem. |
| #17 | 0.20 | 5.20 | 0.40 | — | 0.20 | — | 0.40 | — | — | — | — | — | 93.60 |
| middle | 0.190 | 5.11 | 0.035 | 0.002 | 0.213 | 0.005 | 0.360 | <0.0020 | <0.0020 | 0.005 | 0.013 | <0.0001 | 94.06 |
| #18 | 0.200 | 6.500 | 0.400 | — | 0.200 | — | 0.200 | — | — | — | — | — | 92.500 |
| middle | 0.186 | 6.43 | 0.353 | 0.002 | 0.209 | 0.005 | 0.168 | <0.0020 | <0.0020 | 0.005 | 0.012 | <0.0001 | 92.62 |
| #20 | 0.20 | 6.50 | 0.40 | — | 0.20 | — | 0.20 | — | 0.165 | — | 0.10 | — | 92.24 |
| top | 0.156 | 6.494 | 0.382 | 0.004 | 0.076 | 0.005 | 0.104 | <0.001 | 0.162 | 0.004 | 0.006 | <0.001 | Rem. |
| bottom | 0.174 | 6.768 | 0.393 | 0.004 | 0.082 | 0.005 | 0.104 | <0.001 | 0.162 | 0.004 | 0.006 | <0.001 | Rem. |
| #23 | 0.1 | 4 | 0.3 | — | 0.1 | — | 0.2 | — | 0.1 | 0.2 | — | — | Rem. |
| master alloy 2 | 0.02 | 5.00 | | | 0.02 | | | | | | | | 94.96 |
| analyzed | 0.045 | 5.200 | | 0.005 | 0.078 | 0.005 | | | 0.002 | 0.004 | 0.007 | | 94.65 |
| #31 | 0.044 | 6.500 | 0.000 | 0.050 | 0.100 | 0.000 | 0.200 | 0.000 | 0.165 | 0.100 | 0.000 | 0.000 | 93.880 |
| top | 0.039 | 5.98 | <0.002 | 0.003 | 0.094 | 0.015 | 0.150 | <0.0020 | 0.160 | 0.075 | 0.007 | <0.0001 | 93.46 |
| bottom | 0.043 | 6.54 | <0.002 | 0.002 | 0.100 | 0.007 | 0.310 | <0.0020 | 0.170 | 0.090 | 0.012 | <0.0001 | 92.63 |
| #32 | 0.044 | 5.040 | 0.000 | 0.000 | 0.100 | 1.500 | 0.200 | 0.250 | 0.165 | 0.200 | 0.000 | 0.150 | 92.520 |
| #33 | 0.200 | 5.200 | 0.400 | 0.000 | 0.200 | 0.000 | 0.200 | 0.000 | 0.002 | 0.000 | 0.000 | 0.000 | 93.408 |
| top | 0.200 | 4.78 | 0.350 | 0.002 | 0.200 | 0.006 | 0.180 | 0.002 | 0.002 | 0.005 | 0.013 | <0.0001 | 94.17 |
| bottom | 0.210 | 5.09 | 0.360 | 0.002 | 0.210 | 0.006 | 0.180 | 0.002 | <0.0020 | 0.005 | 0.012 | <0.0001 | 93.82 |
| #46 | 0.044 | 6.500 | 0.000 | 0.000 | 0.100 | 0.000 | 0.200 | 0.250 | 0.165 | 0.100 | 0.100 | 0.150 | 92.391 |
| top | 0.040 | 6.00 | <0.002 | 0.002 | 0.097 | 0.006 | 0.310 | 0.24 | 0.180 | 0.09 | 0.100 | <0.0001 | 92.84 |
| bottom | 0.041 | 6.37 | <0.002 | 0.002 | 0.100 | 0.006 | 0.320 | 0.26 | 0.170 | 0.088 | 0.100 | <0.0001 | 92.44 |
| #50 | 0.200 | 6.500 | 0.400 | 0.000 | 0.200 | 0.000 | 0.200 | 0.000 | 0.165 | 0.000 | 0.100 | 0.000 | 92.235 |
| top | 0.220 | 6.31 | 0.350 | 0.002 | 0.200 | 0.030 | 0.320 | <0.0020 | 0.170 | 0.005 | 0.110 | <0.0001 | 92.19 |
| bottom | 0.220 | 6.73 | 0.370 | 0.002 | 0.220 | 0.007 | 0.320 | <0.002 | 0.170 | 0.005 | 0.110 | <0.0001 | 91.77 |
| #51 | 0.1 | 3.5 | — | 0.1 | 0.1 | — | 0.3 | 0.1 | 0.2 | 0.1 | — | — | Rem. |
| #52 | 0.1 | 4.5 | — | 0.1 | 0.1 | — | 0.3 | 0.1 | 0.2 | 0.1 | — | — | Rem. |
| #53 | 0.1 | 5.5 | — | 0.1 | 0.1 | — | 0.3 | 0.1 | 0.2 | 0.1 | — | — | Rem. |
| #54 | 0.1 | 6.5 | — | 0.1 | 0.1 | — | 0.3 | 0.1 | 0.2 | 0.1 | — | — | Rem. |

A comparison of the compositional components of an exemplary alloy that exhibits improved hot-tearing as compared to other compositions is provided by Table 8.

TABLE 8

Comparison of Compositional Components for Hot-Tearing Embodiments

| Element (wt %) | Inventive Composition (wt %) | RR350 alloy (wt %)[a] | 224 alloy (wt %)[b] |
|---|---|---|---|
| Cu | 6.0-8.0 | 5 | 3.6 |
| Zr | 0.1-0.3 | 0.2 | 0.15 |
| Ti | <0.2 | 0.2 | 0.23 |
| Mn | 0.1-1 | 0.2 | 0.3 |
| Si | <0.2 | ≤0.25 | 0.07 |
| Fe | <0.2 | ≤1.5 | 0.1 |
| Ni | <0.01 | 1.5 | — |
| Mg | <0.01 | <0.2 | 0.35 |
| Co | <0.1 | 0.25 | — |
| Sb | <0.1 | 0.15 | — |
| V | — | — | 0.14 |
| Al | Balance | Balance | Balance |

[a]as disclosed in U.S. Pat. No. 2,781,263
[b]as disclosed in Modern Casting, March 2015, pages 45-50

A comparison of the hot tearing rating of several inventive alloy composition embodiments described herein with baseline 319 alloys and RR350 alloy is included in Table 9. In general, inventive aluminum alloys described herein comprising higher amounts of copper (e.g., 6 wt % to 8 wt %) have improved hot tear resistance as compared to other alloys like the 319 alloys and the RR350 alloys. Table 9 indicates that with higher levels of grain refinement, the higher copper alloy (e.g., approximately 6.5 wt % Cu) displays improved hot tear resistance compared to the baseline 319 alloy.

In a particular disclosed embodiments, a quantitative comparison of the hot tearing susceptibility of various aluminum alloy compositions disclosed herein and other aluminum alloy compositions was conducted. In some embodiments, several castings were made in the shape shown in FIG. 4A. Each casting was examined and given a hot tearing rating number. This numerical rating value was obtained by examining each arm, and assigning a value between 0 and 1 according to the following scheme: 1 point for a fully broken arm; 0.75 points for a severe tear (arm fully cracked but still strongly attached to the central section); 0.5 points for a visible tear (arm not fully cracked); 0.25 points for a tear detectable only under magnifying glass; and 0.0 points when no cracks were present. The number for each arm was summed to give a total for each casting. The numerical rating was between zero (no observed cracks) and six (all arms broken). A total of five castings were poured for each alloy+grain refinement condition. The hot tear number was determined for each casting and the average rating for five castings calculated. A lower number, according to this rating scheme indicated lower susceptibility to hot tearing.

TABLE 9

Comparison of hot tearing resistance of present alloys with RR350 alloy[c] and baseline 319[d] cast aluminum alloys.

| Alloy | Grain refinement (wt % Ti added via Tibor master alloy) | Average Hot tear value |
|---|---|---|
| Inventive alloy 1[a] | none | 4.6 |
| Inventive alloy 1 | 0.02% | 4.45 |
| Inventive alloy 1 | 0.10% | 4.1 |
| Inventive alloy 1 | 0.20% | 4.05 |
| Inventive alloy 2[b] | none | 3.25 |
| Inventive alloy 2 | 0.02% | 3.3 |
| Inventive alloy 2 | 0.10% | 2.05 |
| Inventive alloy 2 | 0.20% | 2.55 |
| 319 Alloy | none | 2.45 |
| 319 Alloy | 0.01% | 2.5 |
| RR350[d] | none | 4.25 |
| RR350 | 0.02% | 4.25 |
| RR350 | 0.10% | 4 |
| RR350 | 0.20% | 4.1 |

[a]"Inventive alloy 1" corresponds to Al—3.6Cu—0.1Mn—0.18Zr—0.01Ti
[b]"Inventive alloy 2" corresponds to Al—6.6Cu—0.48Mn—0.18Zr—0.01Ti
[d]"RR350" corresponds to that disclosed in U.S. Pat. No. 2,781,263

In some embodiments, a microsegregation stratagem can be utilized that stabilizes the unstable (or semi-coherent) interfaces of tetragonal metastable θ' ($Al_2Cu$) precipitate at elevated temperature and imparts extreme coarsening resistance to this family of cast aluminum alloys.

Figure 16:
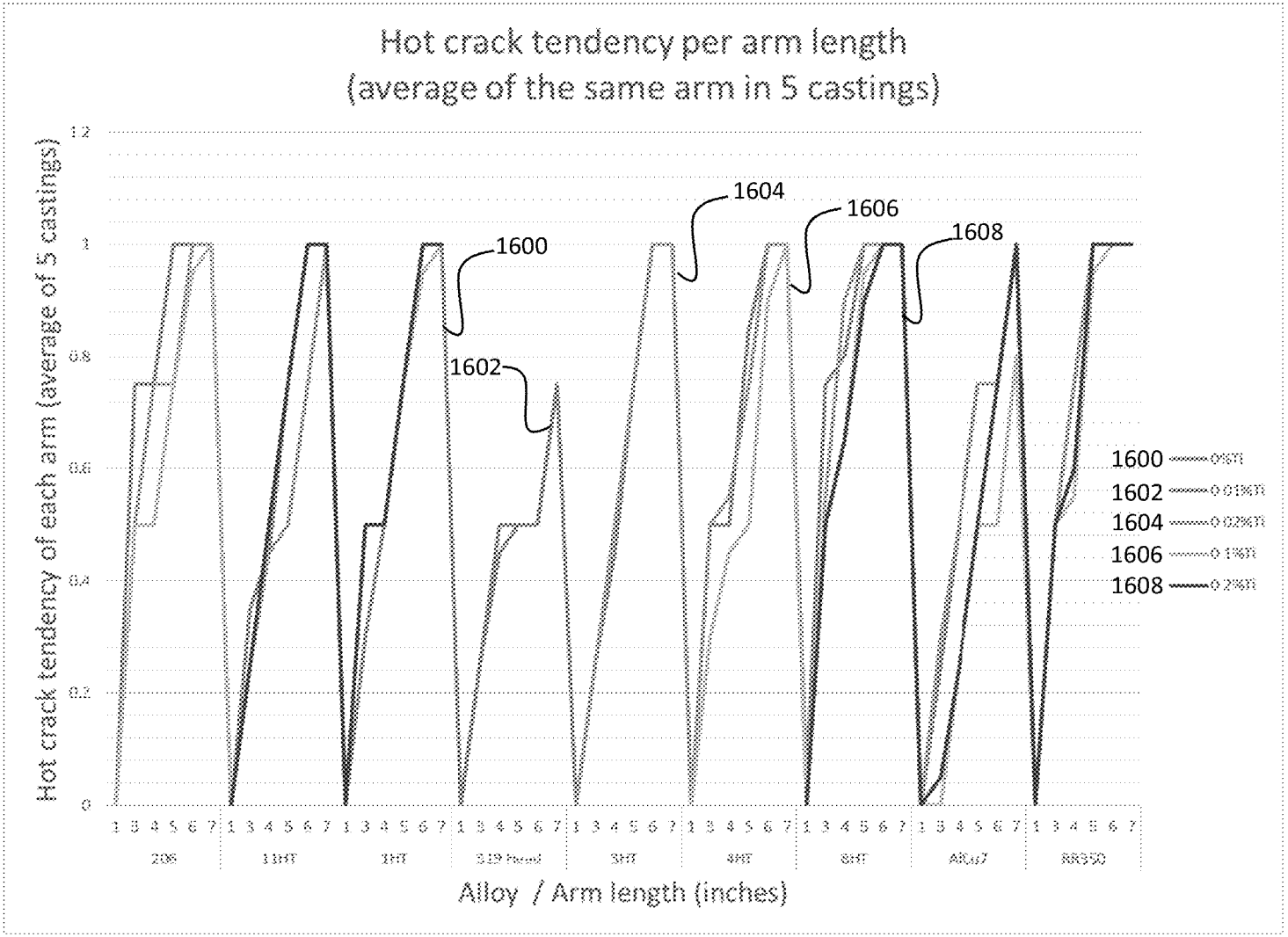
FIG. 16 is a graph of hot tear tendency as a function of alloy and arm length showing hot tearing results from evaluating different alloy compositions, such as representative alloy compositions (e.g., "11HT," "3HT," "4HT," "8HT," and "Al7Cu") and other alloys (e.g., "206," "319 Head," "1HT," and "RR350").
Figure 17:
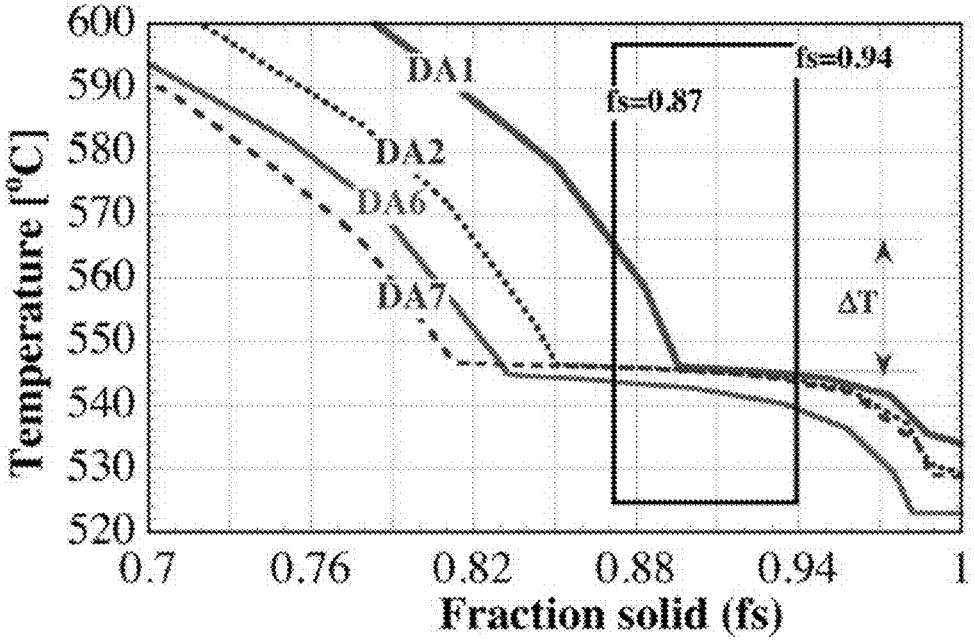
FIG. 17 is a graph of temperature (° C.) as a function of fraction solid (fs), illustrating results obtained from analysis of another alloy composition ("DA1") and representative alloy compositions ("DA2," "DA6," and "DA7").
Figure 18:
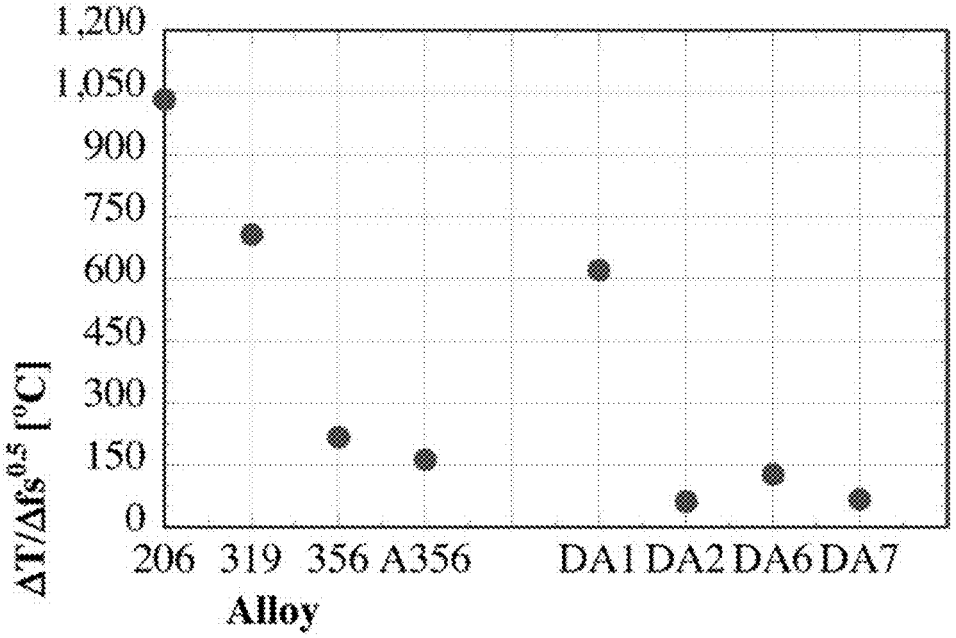
FIG. 18 is a graph showing that certain alloys (e.g., "206," "319," "356," "A356," and "DA1" alloys) will be more prone to hot tearing as compared to representative alloy compositions (e.g., "DA2," "DA6," and "DA7").
Figure 19:
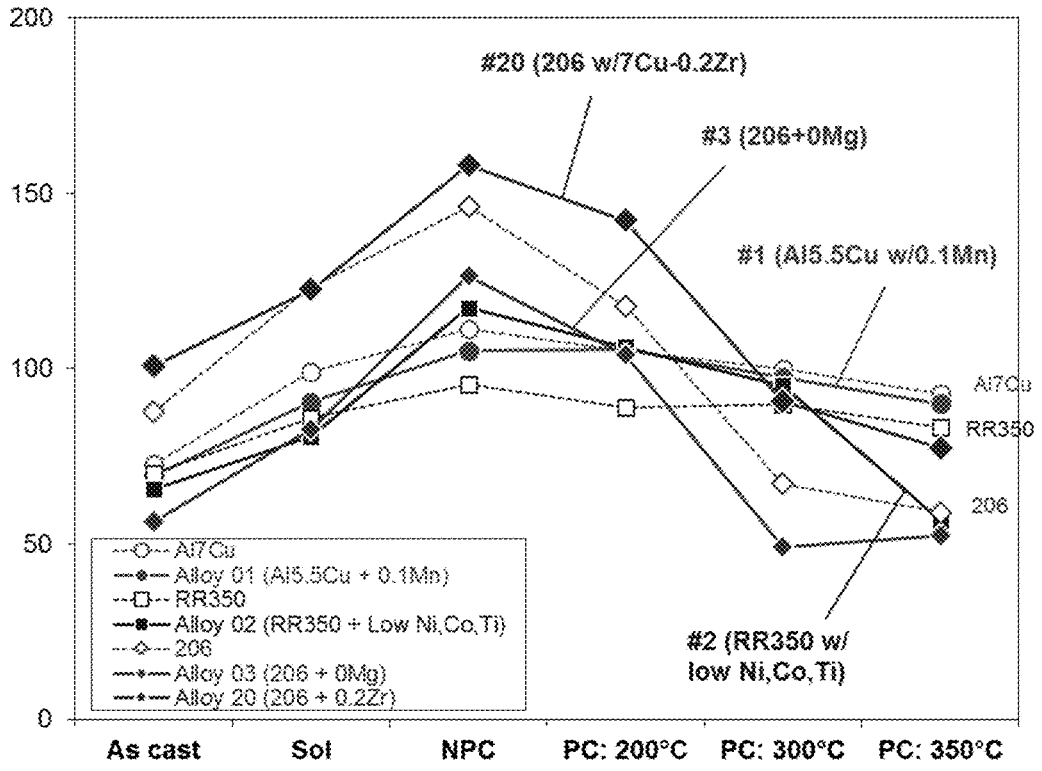
FIG. 19 is a graph of Vickers Hardness at 5 kg load ("HV5") as a function of different heat treatments, which illustrates the stability of the microstructure of various representative alloys and other alloys.
Figure 20:
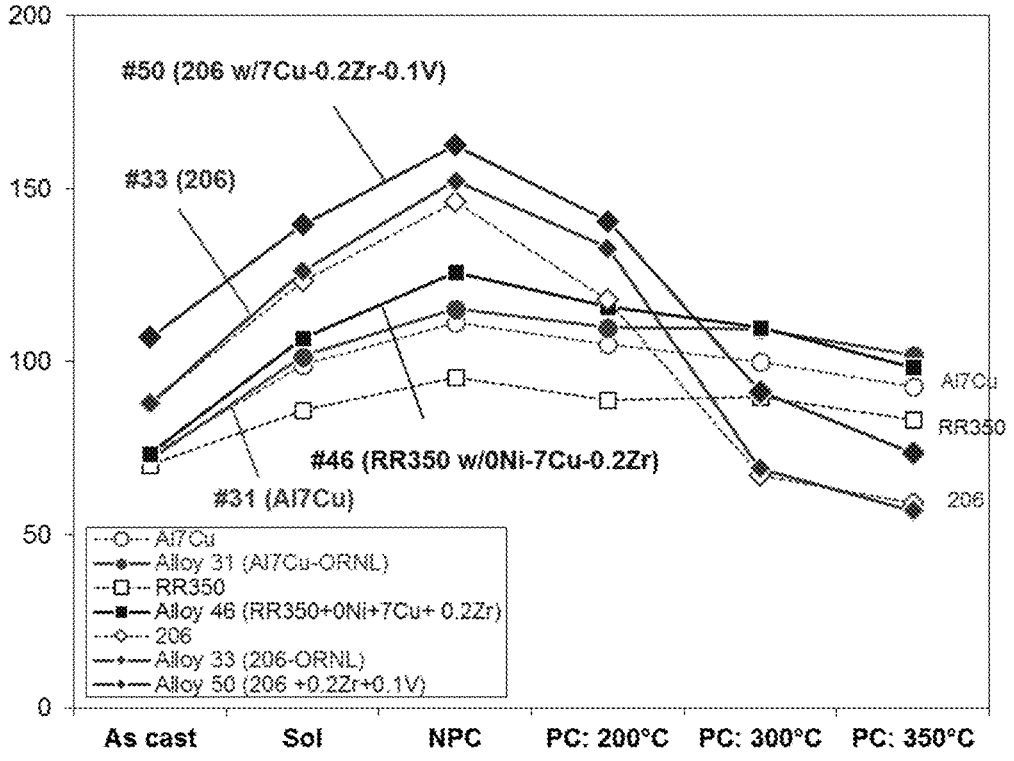
FIG. 20 is a graph of Vickers Hardness at 5 kg load ("HV5") as a function of different heat treatments, which illustrates the stability of the microstructure of various representative alloys and other alloys.
Figure 21:
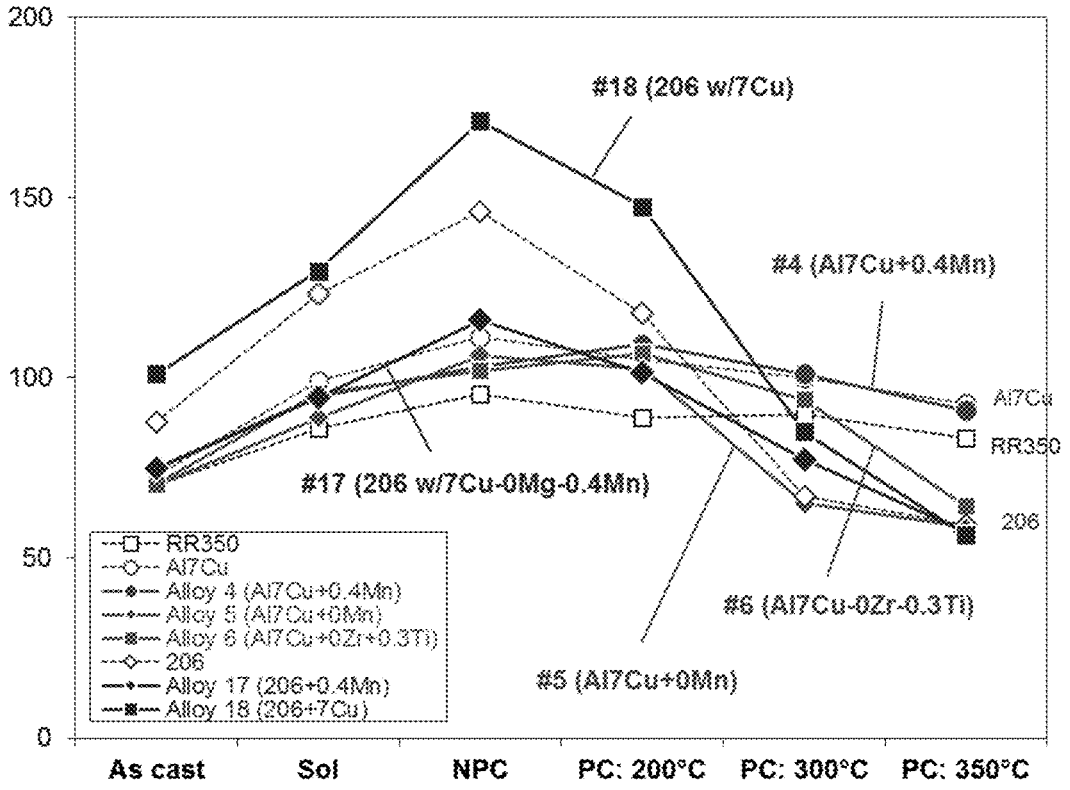
FIG. 21 is a graph of Vickers Hardness at 5 kg load ("HV5") as a function of different heat treatments, which illustrates the stability of the microstructure of various representative alloys and other alloys.
Figure 22:
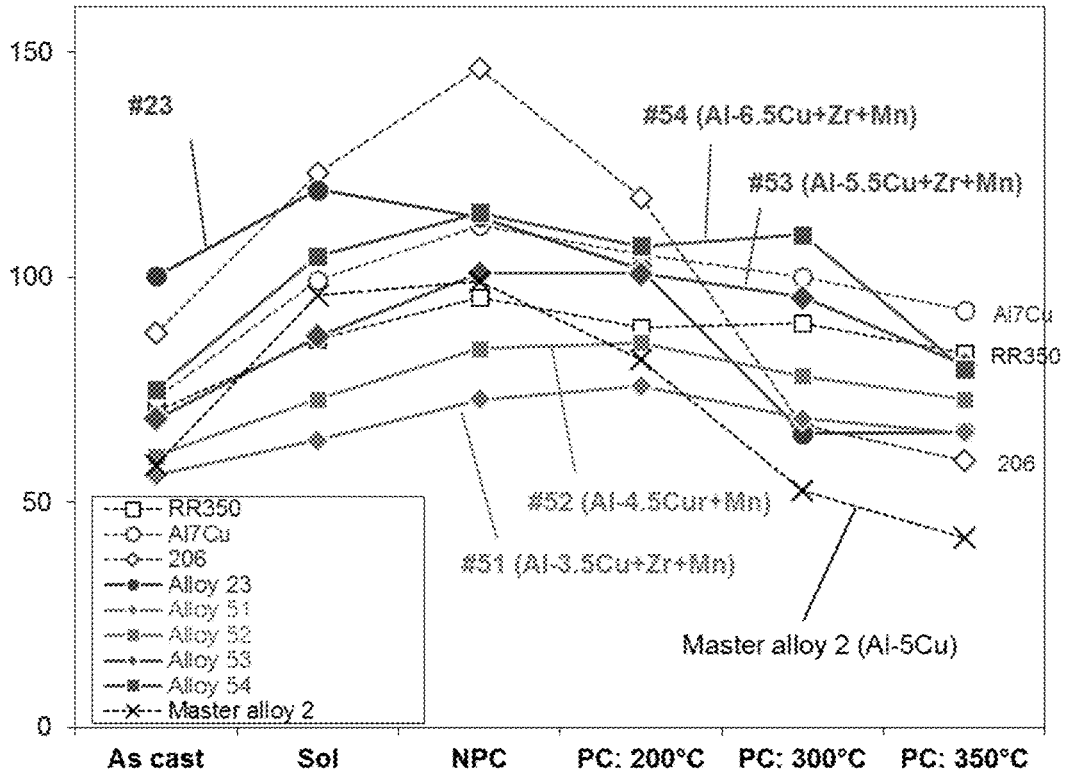
FIG. 22 is a graph of Vickers Hardness at 5 kg load ("HV5") as a function of different heat treatments, which illustrates the stability of the microstructure of various representative alloys and other alloys.

Additional exemplary embodiments of alloys are described by Table 10. Table 10 includes the compositional components and the amounts of each inventive alloy (e.g., DA1-DA7) and further provides a comparison with other alloy compositions (e.g., A356, 206, and 319). Hot-tearing data/results produced by each of the exemplary inventive alloys are provided by Tables 11-14 and hot-tearing data/results produced by each of the other alloys are provided by Tables 15-19. FIG. 16 provides a graph of hot tear tendency per arm length of certain embodiments and FIGS. 17 and 18 show results from hot tearing susceptibility analyses.

TABLE 10

| Name | Alloy | Si % | Cu % | Mg % | Zn % | Fe % | Ni % | Mn % | Co % | Zr % | Ti % | V % | Sb ppm |
|---|---|---|---|---|---|---|---|---|---|---|---|---|---|
| A356 | | | | | | | | | | | | | |
| 319 | 319 Heads | 8.2113 | 3.20669 | 0.2879 | 0.4801 | 0.6534 | 0.0359 | 0.3909 | 0.0038 | 0.0057 | 0.1322 | 0.0159 | 101.11 |
| 206 | 206 | 0.041 | 4.81792 | 0.274 | 0.0061 | 0.0947 | 0.0065 | 0.2541 | 0.003 | 0.0039 | 0.0078 | 0.0122 | 19.33 |
| DA1 | 1HT | 0.0509 | 4.953 | 0.0026 | 0.0124 | 0.1006 | 0.163 | 0.1057 | 0.0008 | 0.1472 | 0.0075 | 0.0131 | 970 |
| DA3 | 3HT | 0.084 | 5.506 | 0.0027 | 0.015 | 0.105 | 0.007 | 0.107 | 0.0004 | 0.173 | 0.006 | 0.012 | 14 |
| DA4 | 4HT | 0.0633 | 6.35 | 0.0017 | 0.0142 | 0.0955 | 0.0081 | 0.306 | 0.2468 | 0.1745 | 0.0923 | 0.1187 | 25 |
| | 5HT | 0.041 | 6.185 | | 0.002 | 0.099 | 0.006 | 0.315 | | 0.175 | 0.089 | 0.100 | 0.15 |
| | 6HT | 5.00 | 6.185 | | 0.002 | 0.099 | 0.006 | 0.315 | 0.25 | 0.175 | 0.089 | 0.100 | |

TABLE 10-continued

| Name | Alloy | Si % | Cu % | Mg % | Zn % | Fe % | Ni % | Mn % | Co % | Zr % | Ti % | V % | Sb ppm |
|---|---|---|---|---|---|---|---|---|---|---|---|---|---|
| | 7HT | | | | | | | | | | | | |
| | 8HT | 0.038 | 3.5 | | 0.086 | 0.080 | 0.005 | 0.105 | | 0.165 | 0.004 | 0.006 | — |
| DA2 | 13HT | 0.0802 | 6.6 | 0.0006 | 0.0162 | 0.0685 | 0.0058 | 0.45 | 0.0008 | 0.2 | 0.0055 | 0.0108 | 28.15 |
| DA5 | 14HT | 0.0802 | 7.3 | 0.0006 | 0.0162 | 0.0685 | 0.0058 | 0.45 | 0.0008 | 0.2 | 0.0055 | 0.0108 | 28.15 |
| DA6 | 15HT | 0.2 | 7.3 | 0.0006 | 0.0162 | 0.2 | 0.0058 | 0.45 | 0.0008 | 0.2 | 0.0055 | 0.0108 | 28.15 |
| DA7 | 16HT | 0.0802 | 8 | 0.0006 | 0.0162 | 0.0685 | 0.0058 | 0.45 | 0.0008 | 0.2 | 0.0055 | 0.0108 | 28.15 |

TABLE 11

Hot Tear Test results from: 3HT alloy (DA3)

| Tibor addition (% Ti): 0% | | | | | | | |
|---|---|---|---|---|---|---|---|
| | Length of arm in permanent mold casting | | | | | | |
| casting | 1" | 3" | 4" | 5" | 6" | 7" | total |
| #1 | 0 | 0.25 | 0.5 | 0.75 | 1 | 1 | 3.5 |
| #2 | 0 | 0.25 | 0.5 | 0.75 | 1 | 1 | 3.5 |
| #3 | 0 | 0.25 | 0.5 | 0.75 | 1 | 1 | 3.5 |
| #4 | 0 | 0.25 | 0.25 | 0.75 | 1 | 1 | 3.25 |
| #5 | 0 | 0.25 | 0.5 | 0.75 | 1 | 1 | 3.5 |
| Average | 0 | 0.25 | 0.45 | 0.75 | 1 | 1 | 3.45 |
| Tibor addition (% Ti): 0.02% | | | | | | | |
| | Length of arm in sand casting | | | | | | |
| casting | 1" | 3" | 4" | 5" | 6" | 7" | total |
| #6 | 0 | 0.25 | 0.5 | 0.75 | 1 | 1 | 3.5 |
| #7 | 0 | 0.25 | 0.5 | 0.75 | 1 | 1 | 3.5 |
| #8 | 0 | 0.25 | 0.5 | 0.75 | 1 | 1 | 3.5 |
| #9 | 0 | 0.25 | 0.5 | 0.75 | 1 | 1 | 3.5 |
| #10 | 0 | 0.25 | 0.5 | 0.75 | 1 | 1 | 3.5 |
| Average | 0 | 0.25 | 0.5 | 0.75 | 1 | 1 | 3.5 |

TABLE 12

Hot Tear Test results from: 8HT alloy

| | Length of arm in sand casting | | | | | | |
|---|---|---|---|---|---|---|---|
| casting | 1" | 3" | 4" | 5" | 6" | 7" | total |
| Tibor addition (% Ti): 0.10% | | | | | | | |
| #11 | 0 | 0.5 | 0.5 | 1 | 1 | 1 | 4 |
| #12 | 0 | 0.5 | 0.5 | 0.75 | 1 | 1 | 3.75 |
| #13 | 0 | 0.5 | 0.75 | 1 | 1 | 1 | 4.25 |
| #44 | 0 | 0.5 | 0.75 | 1 | 1 | 1 | 4.25 |
| #15 | 0 | 0.5 | 0.75 | 1 | 1 | 1 | 4.25 |
| Average | 0 | 0.5 | 0.65 | 0.95 | 1 | 1 | 4.1 |
| Tibor addition (% Ti): 0.20% | | | | | | | |
| #16 | 0 | 0.5 | 0.5 | 0.75 | 1 | 1 | 3.75 |
| #17 | 0 | 0.5 | 0.5 | 0.75 | 1 | 1 | 3.75 |
| #18 | 0 | 0.5 | 0.75 | 1 | 1 | 1 | 4.25 |
| #19 | 0 | 0.5 | 0.75 | 1 | 1 | 1 | 4.25 |
| #20 | 0 | 0.5 | 0.75 | 1 | 1 | 1 | 4.25 |
| Average | 0 | 0.5 | 0.65 | 0.9 | 1 | 1 | 4.05 |

TABLE 12

Hot Tear Test results from: 8HT alloy

| Tibor addition (% Ti): 0% | | | | | | | |
|---|---|---|---|---|---|---|---|
| | Length of arm in permanent mold casting | | | | | | |
| casting | 1" | 3" | 4" | 5" | 6" | 7" | total |
| #1 | 0.25 | 0.75 | 0.75 | 1 | 1 | 1 | 4.75 |
| #2 | 0 | 0.75 | 0.75 | 1 | 1 | 1 | 4.5 |
| #3 | 0 | 0.75 | 0.75 | 1 | 1 | 1 | 4.5 |
| #4 | 0 | 0.75 | 0.75 | 1 | 1 | 1 | 4.5 |
| #5 | 0 | 0.75 | 1 | 1 | 1 | 1 | 4.75 |
| Average | 0.05 | 0.75 | 0.8 | 1 | 1 | 1 | 4.6 |
| Tibor addition (% Ti): 0.02% | | | | | | | |
| | Length of arm in sand casting | | | | | | |
| casting | 1" | 3" | 4" | 5" | 6" | 7" | total |
| #6 | 0 | 0.5 | 1 | 1 | 1 | 1 | 4.5 |
| #7 | 0 | 0.5 | 1 | 1 | 1 | 1 | 4.5 |
| #8 | 0 | 0.75 | 0.75 | 1 | 1 | 1 | 4.5 |
| #9 | 0 | 0.5 | 0.75 | 1 | 1 | 1 | 4.25 |
| #10 | 0 | 0.5 | 1 | 1 | 1 | 1 | 4.5 |
| Average | 0 | 0.55 | 0.9 | 1 | 1 | 1 | 4.45 |

TABLE 13

Hot Tear Test results from: 11HT alloy

| Tibor addition (% Ti): 0% | | | | | | | |
|---|---|---|---|---|---|---|---|
| | Length of arm in permanent mold casting | | | | | | |
| casting | 1" | 3" | 4" | 5" | 6" | 7" | total |
| #1 | 0 | 0.25 | 0.5 | 0.75 | 1 | 1 | 3.5 |
| #2 | 0 | 0.25 | 0.5 | 0.75 | 1 | 1 | 3.5 |
| #3 | 0 | 0.25 | 0.25 | 0.75 | 1 | 1 | 3.25 |
| #4 | 0 | 0.5 | 0.5 | 0.75 | 1 | 1 | 3.75 |
| #5 | 0 | 0.5 | 0.5 | 0.75 | 1 | 1 | 3.75 |
| Average | 0 | 0.35 | 0.45 | 0.75 | 1 | 1 | 3.55 |
| Tibor addition (% Ti): 0.02% | | | | | | | |
| | Length of arm in sand casting | | | | | | |
| casting | 1" | 3" | 4" | 5" | 6" | 7" | total |
| #6 | 0 | 0.25 | 0.5 | 0.5 | 0.75 | 1 | 3 |
| #7 | 0 | 0.25 | 0.25 | 0.5 | 0.75 | 1 | 2.75 |
| #8 | 0 | 0.25 | 0.5 | 0.5 | 0.75 | 1 | 3 |
| #9 | 0 | 0.25 | 0.5 | 0.5 | 0.75 | 1 | 3 |
| #10 | 0 | 0.25 | 0.5 | 0.5 | 0.75 | 1 | 3 |
| Average | 0 | 0.25 | 0.45 | 0.5 | 0.75 | 1 | 2.95 |

TABLE 13

| Hot Tear Test results from: 11HT alloy | | | | | | | |
|---|---|---|---|---|---|---|---|
| | Length of arm in sand casting | | | | | | |
| casting | 1" | 3" | 4" | 5" | 6" | 7" | total |
| Tibor addition (% Ti): 0.10% | | | | | | | |
| #11 | 0 | 0.25 | 0.5 | 0.75 | 1 | 1 | 3.5 |
| #12 | 0 | 0.25 | 0.5 | 0.75 | 1 | 1 | 3.5 |
| #13 | 0 | 0.25 | 0.5 | 0.75 | 1 | 1 | 3.5 |
| #44 | 0 | 0.25 | 0.5 | 0.75 | 1 | 1 | 3.5 |
| #15 | 0 | 0.25 | 0.5 | 0.75 | 1 | 1 | 3.5 |
| Average | 0 | 0.25 | 0.5 | 0.75 | 1 | 1 | 3.5 |
| Tibor addition (% Ti): 0.20% | | | | | | | |
| #16 | 0 | 0.25 | 0.5 | 0.75 | 1 | 1 | 3.5 |
| #17 | 0 | 0.25 | 0.5 | 0.75 | 1 | 1 | 3.5 |
| #18 | 0 | 0.25 | 0.5 | 0.75 | 1 | 1 | 3.5 |
| #19 | 0 | 0.25 | 0.5 | 0.75 | 1 | 1 | 3.5 |
| #20 | 0 | 0.25 | 0.5 | 0.75 | 1 | 1 | 3.5 |
| Average | 0 | 0.25 | 0.5 | 0.75 | 1 | 1 | 3.5 |

TABLE 14

| Hot Tear Test results from: AlCu7 alloy | | | | | | | |
|---|---|---|---|---|---|---|---|
| Tibor addition (% Ti): 0% | | | | | | | |
| | Length of arm in permanent mold casting | | | | | | |
| casting | 1" | 3" | 4" | 5" | 6" | 7" | total |
| #1 | 0 | 0.25 | 0.5 | 0.75 | 0.75 | 1 | 3.25 |
| #2 | 0 | 0.25 | 0.5 | 0.75 | 0.75 | 1 | 3.25 |
| #3 | 0 | 0.25 | 0.5 | 0.75 | 0.75 | 1 | 3.25 |
| #4 | 0 | 0.25 | 0.5 | 0.75 | 0.75 | 1 | 3.25 |
| #5 | 0 | 0.25 | 0.5 | 0.75 | 0.75 | 1 | 3.25 |
| Average | 0 | 0.25 | 0.5 | 0.75 | 0.75 | 1 | 3.25 |
| Tibor addition (% Ti): 0.02% | | | | | | | |
| | Length of arm in sand casting | | | | | | |
| casting | 1" | 3" | 4" | 5" | 6" | 7" | total |
| #6 | 0 | 0.5 | 0.5 | 0.75 | 0.75 | 1 | 3.5 |
| #7 | 0 | 0.25 | 0.5 | 0.75 | 0.75 | 1 | 3.25 |
| #8 | 0 | 0.25 | 0.5 | 0.75 | 0.75 | 1 | 3.25 |
| #9 | 0 | 0.25 | 0.5 | 0.75 | 0.75 | 1 | 3.25 |
| #10 | 0 | 0.25 | 0.5 | 0.75 | 0.75 | 1 | 3.25 |
| Average | 0 | 0.3 | 0.5 | 0.75 | 0.75 | 1 | 3.3 |

TABLE 14

| Hot Tear Test results from: AlCu7 alloy | | | | | | | |
|---|---|---|---|---|---|---|---|
| | Length of arm in sand casting | | | | | | |
| casting | 1" | 3" | 4" | 5" | 6" | 7" | total |
| Tibor addition (% Ti): 0.10% | | | | | | | |
| #11 | 0 | 0 | 0.25 | 0.5 | 0.5 | 1 | 2.25 |
| #12 | 0 | 0 | 0.25 | 0.5 | 0.5 | 0.75 | 2 |
| #13 | 0 | 0 | 0.25 | 0.5 | 0.5 | 0.75 | 2 |
| #44 | 0 | 0 | 0.25 | 0.5 | 0.5 | 0.75 | 2 |
| #15 | 0 | 0 | 0.25 | 0.5 | 0.5 | 0.75 | 2 |
| Average | 0 | 0 | 0.25 | 0.5 | 0.5 | 0.8 | 2.05 |
| Tibor addition (% Ti): 0.20% | | | | | | | |
| #16 | 0 | 0 | 0.25 | 0.5 | 0.75 | 1 | 2.5 |
| #17 | 0 | 0 | 0.25 | 0.5 | 0.75 | 1 | 2.5 |
| #18 | 0 | 0.25 | 0.25 | 0.5 | 0.75 | 1 | 2.75 |

TABLE 14-continued

| Hot Tear Test results from: AlCu7 alloy | | | | | | | |
|---|---|---|---|---|---|---|---|
| | Length of arm in sand casting | | | | | | |
| casting | 1" | 3" | 4" | 5" | 6" | 7" | total |
| #19 | 0 | 0 | 0.25 | 0.5 | 0.75 | 1 | 2.5 |
| #20 | 0 | 0 | 0.25 | 0.5 | 0.75 | 1 | 2.5 |
| Average | 0 | 0.05 | 0.25 | 0.5 | 0.75 | 1 | 2.55 |

TABLE 15

| Hot Tear Test results from: 1HT alloy (DA1) | | | | | | | |
|---|---|---|---|---|---|---|---|
| Tibor addition (% Ti): 0% | | | | | | | |
| | Length of arm in permanent mold casting | | | | | | |
| casting | 1" | 3" | 4" | 5" | 6" | 7" | total |
| #1 | 0 | 0.25 | 0.5 | 0.75 | 1 | 1 | 3.5 |
| #2 | 0 | 0.25 | 0.5 | 0.75 | 1 | 1 | 3.5 |
| #3 | 0 | 0.25 | 0.5 | 0.75 | 1 | 1 | 3.5 |
| #4 | 0 | 0.5 | 0.5 | 0.75 | 1 | 1 | 3.75 |
| #5 | 0 | 0.25 | 0.5 | 0.75 | 1 | 1 | 3.5 |
| Average | 0 | 0.3 | 0.5 | 0.75 | 1 | 1 | 3.55 |
| Tibor addition (% Ti): 0.02% | | | | | | | |
| | Length of arm in sand casting | | | | | | |
| casting | 1" | 3" | 4" | 5" | 6" | 7" | total |
| #6 | 0 | 0.5 | 0.5 | 0.75 | 1 | 1 | 3.75 |
| #7 | 0 | 0.5 | 0.5 | 0.75 | 1 | 1 | 3.75 |
| #8 | 0 | 0.5 | 0.5 | 0.75 | 1 | 1 | 3.75 |
| #9 | 0 | 0.5 | 0.5 | 0.75 | 1 | 1 | 3.75 |
| #10 | 0 | 0.5 | 0.5 | 0.75 | 1 | 1 | 3.75 |
| Average | 0 | 0.5 | 0.5 | 0.75 | 1 | 1 | 3.75 |

TABLE 15

| Hot Tear Test results from: 1HT alloy (DA1) | | | | | | | |
|---|---|---|---|---|---|---|---|
| | Length of arm in sand casting | | | | | | |
| casting | 1" | 3" | 4" | 5" | 6" | 7" | total |
| Tibor addition (% Ti): 0.10% | | | | | | | |
| #11 | 0 | 0.5 | 0.5 | 0.5 | 0.75 | 1 | 3.25 |
| #12 | 0 | 0.5 | 0.5 | 0.75 | 1 | 1 | 3.75 |
| #13 | 0 | 0.5 | 0.5 | 0.75 | 1 | 1 | 3.75 |
| #44 | 0 | 0.5 | 0.5 | 1 | 1 | 1 | 4 |
| #15 | 0 | 0.5 | 0.5 | 0.75 | 1 | 1 | 3.75 |
| Average | 0 | 0.5 | 0.5 | 0.75 | 0.95 | 1 | 3.7 |
| Tibor addition (% Ti): 0.20% | | | | | | | |
| #16 | 0 | 0.5 | 0.5 | 0.75 | 1 | 1 | 3.75 |
| #17 | 0 | 0.5 | 0.5 | 0.75 | 1 | 1 | 3.75 |
| #18 | 0 | 0.5 | 0.5 | 0.75 | 1 | 1 | 3.75 |
| #19 | 0 | 0.5 | 0.5 | 0.75 | 1 | 1 | 3.75 |
| #20 | 0 | 0.5 | 0.5 | 0.75 | 1 | 1 | 3.75 |
| Average | 0 | 0.5 | 0.5 | 0.75 | 1 | 1 | 3.75 |

TABLE 16

| Hot Tear Test results from: 4HT alloy (DA4) | | | | | | | |
|---|---|---|---|---|---|---|---|
| Tibor addition (% Ti): 0% | | | | | | | |
| | Length of arm in permanent mold casting | | | | | | |
| casting | 1" | 3" | 4" | 5" | 6" | 7" | total |
| #1 | 0 | 0.5 | 0.5 | 1 | 1 | 1 | 4 |
| #2 | 0 | 0.5 | 0.5 | 0.75 | 1 | 1 | 3.75 |
| #3 | 0 | 0.5 | 0.5 | 0.75 | 1 | 1 | 3.75 |
| #4 | 0 | 0.5 | 0.5 | 0.75 | 1 | 1 | 3.75 |
| #5 | 0 | 0.5 | 0.5 | 1 | 1 | 1 | 4 |
| Average | 0 | 0.5 | 0.5 | 0.85 | 1 | 1 | 3.85 |
| | Length of arm in sand casting | | | | | | |
| casting | 1" | 3" | 4" | 5" | 6" | 7" | total |
| Tibor addition (% Ti): 0.02% | | | | | | | |
| #6 | 0 | 0.5 | 0.5 | 0.75 | 1 | 1 | 3.75 |
| #7 | 0 | 0.5 | 0.5 | 0.75 | 1 | 1 | 3.75 |
| #8 | 0 | 0.5 | 0.5 | 0.75 | 1 | 1 | 3.75 |
| #9 | 0 | 0.5 | 0.5 | 0.75 | 1 | 1 | 3.75 |
| #10 | 0 | 0.5 | 0.75 | 0.75 | 1 | 1 | 4 |
| Average | 0 | 0.5 | 0.55 | 0.75 | 1 | 1 | 3.8 |
| Tibor addition (% Ti): 0.10% | | | | | | | |
| #11 | 0 | 0.5 | 0.5 | 0.5 | 1 | 1 | 3.5 |
| #12 | 0 | 0.25 | 0.5 | 0.5 | 1 | 1 | 3.25 |
| #13 | 0 | 0.25 | 0.5 | 0.5 | 0.75 | 1 | 3 |
| #44 | 0 | 0.25 | 0.25 | 0.5 | 0.75 | 1 | 2.75 |
| #15 | 0 | 0.25 | 0.5 | 0.5 | 1 | 1 | 3.25 |
| Average | 0 | 0.3 | 0.45 | 0.5 | 0.9 | 1 | 3.15 |

TABLE 17

| Hot Tear Test results from: 206 alloy | | | | | | | |
|---|---|---|---|---|---|---|---|
| Tibor addition (% Ti): 0% | | | | | | | |
| | Length of arm in permanent mold casting | | | | | | |
| casting | 1" | 3" | 4" | 5" | 6" | 7" | total |
| #1 | 0 | 0.75 | 0.75 | 1 | 1 | 1 | 4.5 |
| #2 | 0 | 0.75 | 0.75 | 1 | 1 | 1 | 4.5 |
| #3 | 0 | 0.75 | 0.75 | 1 | 1 | 1 | 4.5 |
| #4 | 0 | 0.75 | 0.75 | 1 | 1 | 1 | 4.5 |
| #5 | 0 | 0.75 | 0.75 | 1 | 1 | 1 | 4.5 |
| Average | 0 | 0.75 | 0.75 | 1 | 1 | 1 | 4.5 |
| | Length of arm in sand casting | | | | | | |
| casting | 1" | 3" | 4" | 5" | 6" | 7" | total |
| Tibor addition (% Ti): 0.02% | | | | | | | |
| #6 | 0 | 0.5 | 0.75 | 0.75 | 1 | 1 | 4 |
| #7 | 0 | 0.5 | 0.75 | 0.75 | 1 | 1 | 4 |
| #8 | 0 | 0.5 | 0.75 | 0.75 | 1 | 1 | 4 |
| #9 | 0 | 0.5 | 0.75 | 0.75 | 1 | 1 | 4 |
| #10 | 0 | 0.5 | 0.75 | 0.75 | 1 | 1 | 4 |
| Average | 0 | 0.5 | 0.75 | 0.75 | 1 | 1 | 4 |
| Tibor addition (% Ti): 0.10% | | | | | | | |
| #11 | 0 | 0.5 | 0.5 | 0.75 | 1 | 1 | 3.75 |
| #12 | 0 | 0.5 | 0.5 | 0.75 | 1 | 1 | 3.75 |
| #13 | 0 | 0.5 | 0.5 | 0.75 | 0.75 | 1 | 3.5 |
| #44 | 0 | 0.5 | 0.5 | 0.75 | 1 | 1 | 3.75 |
| #15 | 0 | 0.5 | 0.5 | 0.75 | 1 | 1 | 3.75 |
| Average | 0 | 0.5 | 0.5 | 0.75 | 0.95 | 1 | 3.7 |

TABLE 18

| Hot Tear Test results from: 319 Heads | | | | | | | |
|---|---|---|---|---|---|---|---|
| Tibor addition (% Ti): Ti Residual | | | | | | | |
| | Length of arm in permanent mold casting | | | | | | |
| casting | 1" | 3" | 4" | 5" | 6" | 7" | total |
| #1 | 0 | 0.25 | 0.25 | 0.5 | 0.5 | 0.75 | 2.25 |
| #2 | 0 | 0.25 | 0.5 | 0.5 | 0.5 | 0.75 | 2.5 |
| #3 | 0 | 0.25 | 0.5 | 0.5 | 0.5 | 0.75 | 2.5 |
| #4 | 0 | 0.25 | 0.5 | 0.5 | 0.5 | 0.75 | 2.5 |
| #5 | 0 | 0.25 | 0.5 | 0.5 | 0.5 | 0.75 | 2.5 |
| Average | 0 | 0.25 | 0.45 | 0.5 | 0.5 | 0.75 | 2.45 |
| Tibor addition (% Ti): Ti Residual + 0.01Ti | | | | | | | |
| | Length of arm in sand casting | | | | | | |
| casting | 1" | 3" | 4" | 5" | 6" | 7" | total |
| #6 | 0 | 0.25 | 0.5 | 0.5 | 0.5 | 0.75 | 2.5 |
| #7 | 0 | 0.25 | 0.5 | 0.5 | 0.5 | 0.75 | 2.5 |
| #8 | 0 | 0.25 | 0.5 | 0.5 | 0.5 | 0.75 | 2.5 |
| #9 | 0 | 0.25 | 0.5 | 0.5 | 0.5 | 0.75 | 2.5 |
| #10 | 0 | 0.25 | 0.5 | 0.5 | 0.5 | 0.75 | 2.5 |
| Average | 0 | 0.25 | 0.5 | 0.5 | 0.5 | 0.75 | 2.5 |

TABLE 19

| Hot Tear Test results from: RR350 alloy | | | | | | | |
|---|---|---|---|---|---|---|---|
| Tibor addition (% Ti): 0% | | | | | | | |
| | Length of arm in permanent mold casting | | | | | | |
| casting | 1" | 3" | 4" | 5" | 6" | 7" | total |
| #1 | 0 | 0.5 | 0.75 | 1 | 1 | 1 | 4.25 |
| #2 | 0 | 0.5 | 0.75 | 1 | 1 | 1 | 4.25 |
| #3 | 0 | 0.5 | 0.75 | 1 | 1 | 1 | 4.25 |
| #4 | 0 | 0.5 | 0.75 | 1 | 1 | 1 | 4.25 |
| #5 | 0 | 0.5 | 0.75 | 1 | 1 | 1 | 4.25 |
| Average | 0 | 0.5 | 0.75 | 1 | 1 | 1 | 4.25 |
| | Length of arm in sand casting | | | | | | |
| casting | 1" | 3" | 4" | 5" | 6" | 7" | total |
| Tibor addition (% Ti): 0.02% | | | | | | | |
| #6 | 0 | 0.5 | 0.75 | 1 | 1 | 1 | 4.25 |
| #7 | 0 | 0.5 | 0.75 | 1 | 1 | 1 | 4.25 |
| #8 | 0 | 0.5 | 0.75 | 1 | 1 | 1 | 4.25 |
| #9 | 0 | 0.5 | 0.75 | 1 | 1 | 1 | 4.25 |
| #10 | 0 | 0.5 | 0.75 | 1 | 1 | 1 | 4.25 |
| Average | 0 | 0.5 | 0.75 | 1 | 1 | 1 | 4.25 |
| Tibor addition (% Ti): 0.10% | | | | | | | |
| #11 | 0 | 0.5 | 0.5 | 0.75 | 1 | 1 | 3.75 |
| #12 | 0 | 0.5 | 0.5 | 1 | 1 | 1 | 4 |
| #13 | 0 | 0.5 | 0.5 | 1 | 1 | 1 | 4 |
| #44 | 0 | 0.5 | 0.5 | 1 | 1 | 1 | 4 |
| #15 | 0 | 0.5 | 0.75 | 1 | 1 | 1 | 4.25 |
| Average | 0 | 0.5 | 0.55 | 0.95 | 1 | 1 | 4 |
| Tibor addition (% Ti): 0.20% | | | | | | | |
| #16 | 0 | 0.5 | 0.5 | 1 | 1 | 1 | 4 |
| #17 | 0 | 0.5 | 0.5 | 1 | 1 | 1 | 4 |
| #18 | 0 | 0.5 | 0.75 | 1 | 1 | 1 | 4.25 |
| #19 | 0 | 0.5 | 0.5 | 1 | 1 | 1 | 4 |
| #20 | 0 | 0.5 | 0.75 | 1 | 1 | 1 | 4.25 |
| Average | 0 | 0.5 | 0.6 | 1 | 1 | 1 | 4.1 |

Figure 5A:
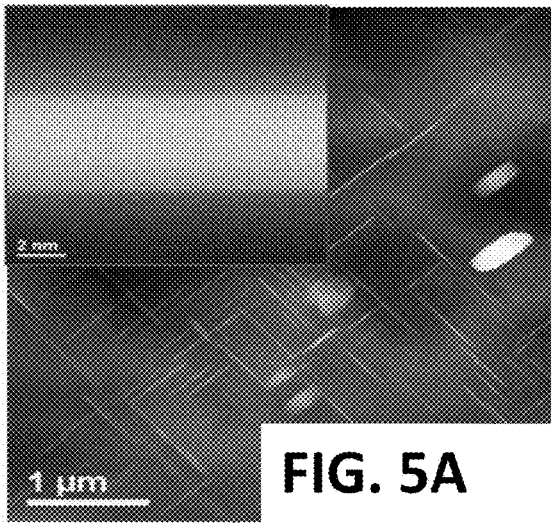
FIGS. 5A-5D illustrate a comparison of two Al-5 wt % Cu alloys with similar overall chemistry and grain-structure, but different precipitate structure and tensile strengths.
Figure 5B:
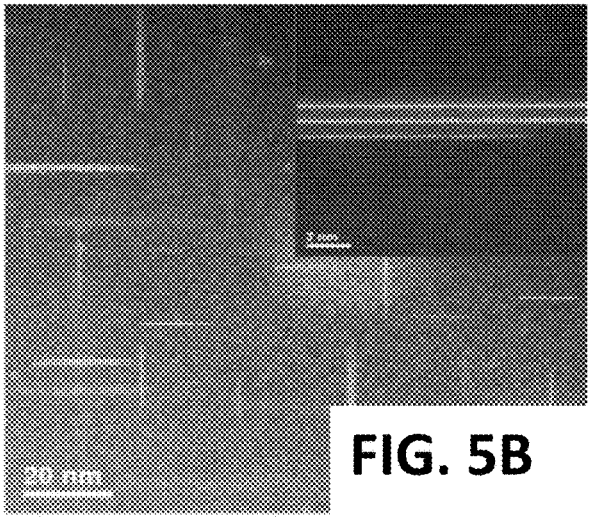
Figure 5C:
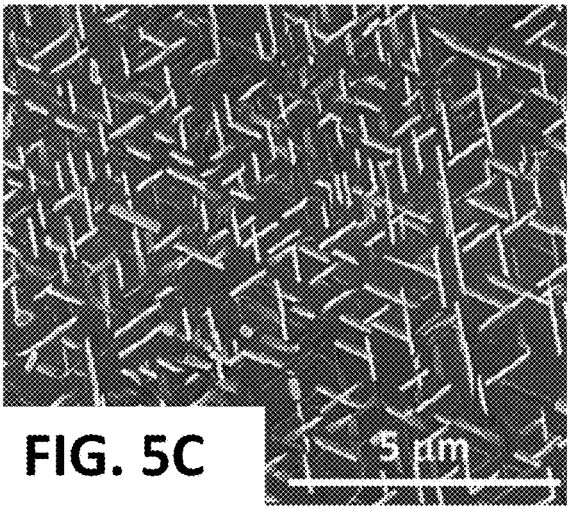
Figure 5D:
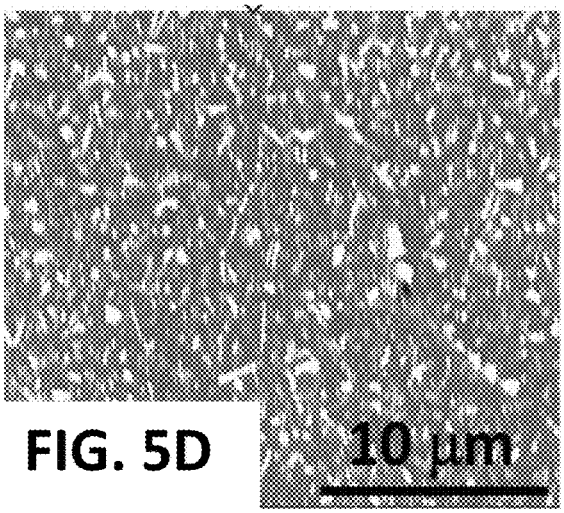
Figure 6:
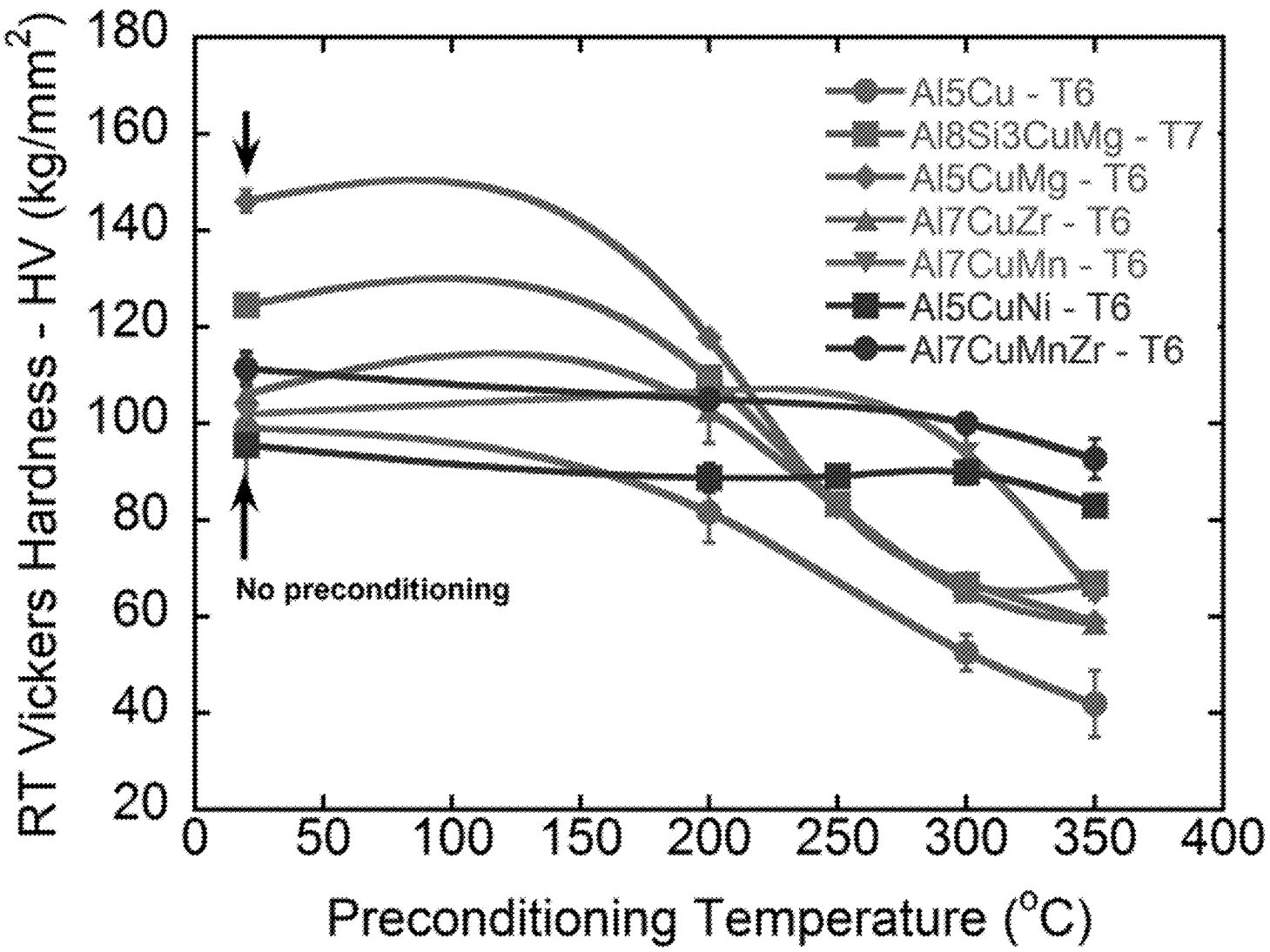
FIG. 6 is a graph showing the relationship between the coarsening of the strengthening precipitates and the mechanical response of different aluminum alloys through the change in room temperature Vickers Hardness after elevated temperature preconditioning.
Figure 12C:
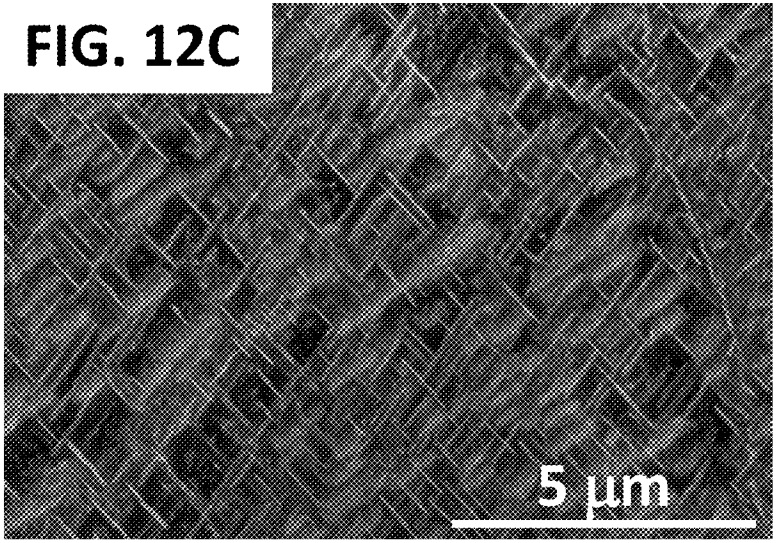
FIGS. 12A-12D show that the two type B alloys of FIG. 5 have larger precipitates after age hardening that exhibit high temperature morphological stability.
Figure 12D:
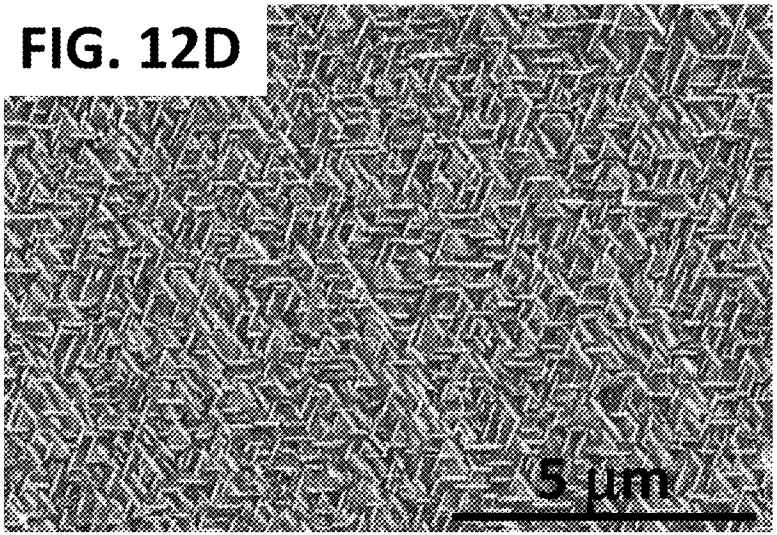
Figure 12A:
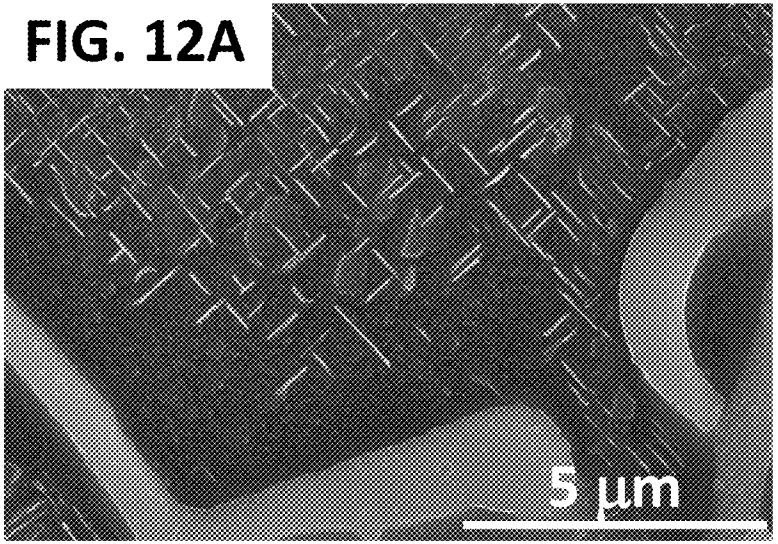
Figure 12B:
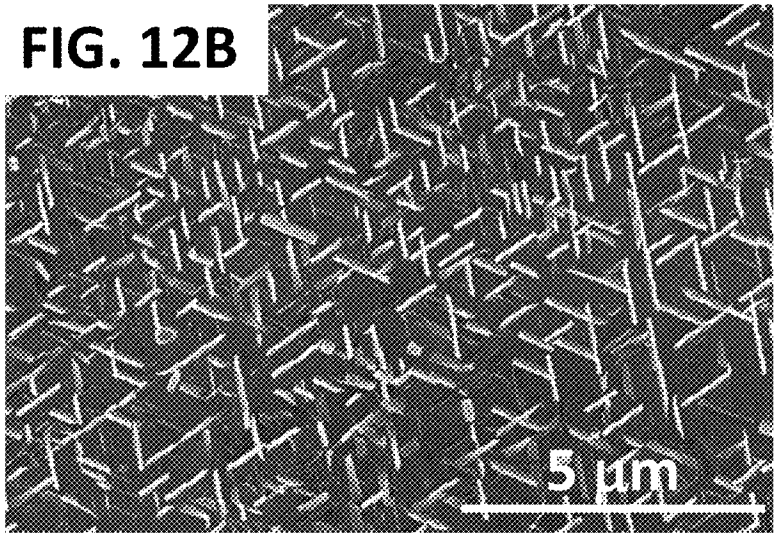

FIGS. 5A-5D include a comparison of two aluminum alloys comprising 5 wt % copper and either nickel or magnesium. These Al-5 wt % Cu alloys (referred to as Al5CuNi and Al5CuMg) had similar overall chemistry (Table 20) and grain-structure but different precipitate structure and tensile properties. The relationship between the coarsening of the strengthening precipitates and the mechanical response was evaluated for several aluminum alloys through the change in room temperature Vickers Hardness after elevated temperature preconditioning (FIG. 6). The variation of Vickers hardness with preconditioning allows identification of two distinct class of alloys (see Table 20 for alloy compositions); (i) type A alloys (represented by Al5Cu, Al8Si3CuMg, Al5CuMg, and Al7CuZr in FIG. 6) can have relatively high hardness (and strength) at lower temperature but which soften rapidly after prolonged exposure at temperatures above 200° C. (e.g., Al5CuMg, Al8Si3Cu and Al7CuZr as indicated in FIG. 6) and (ii) type B alloys (represented by Al5CuNi and Al7CuMnZr in FIG. 6) have lower room temperature strength but retain their hardness (and thus strength) after prolonged exposure at high temperature. The two type B alloys, Al5CuNi (FIGS. 12A and 12B) and Al7CuMnZr (FIGS. 12C and 12D) have larger precipitates after age hardening that exhibit high temperature morphological stability (FIGS. 12A-12D), with the Al7CuMnZr embodiment illustrating superior mechanical properties at elevated temperature, whereas the type A alloys soften at elevated temperature because of the coarsening of precipitates. It is noted that the exceptional elevated temperature mechanical properties in the Al7CuMnZr embodiment with larger strengthening precipitates is counterintuitive since higher strength alloys are associated with finer microstructural features. It therefore was unexpected to observe the results obtained for this embodiment. In particular disclosed embodiments, a Vickers hardness test is used to determine the stability and hardness of the alloy compositions disclosed herein. Such a test can comprise using a Vickers indentor and contacting an alloy casting with the indentor at a particular load weight, such as 5 kg. Any resulting indentation is then examined under a suitable microscope and the two diagonals of any resulting square-shaped indentation are measured. The two diagonal lengths, in combination with the load value provides the Vickers hardness using the equation hardness=$1.854\times(F/d^2)$, wherein F is the load in kgf and d is the arithmetic mean of the two diagonals in mm.

TABLE 20

| Alloy | Name | Cu | Si | Mg | Zn | Fe | Ni | Mn | Co | Zr |
|---|---|---|---|---|---|---|---|---|---|---|
| Al5Cu-T6 | — | 5.20 | 0.05 | — | 0.01 | 0.08 | 0.01 | — | — | — |
| Al8Si3CuMg-T7 | 319 | 3.17 | 8.29 | 0.34 | 0.31 | 0.68 | 0.03 | 0.39 | — | — |
| Al5CuMg-T6 | 206 | 5.18 | 0.14 | 0.37 | 0.01 | 0.15 | — | 0.25 | — | — |
| Al7CuZr-T6 | (#5) | 6.25 | 0.05 | — | 0.01 | 0.11 | 0.01 | — | — | 0.13 |
| Al7CuMn-T6 | (#6) | 6.29 | 0.05 | — | 0.01 | 0.11 | 0.01 | 0.19 | — | 0.01 |
| Al5CuNi-T6 | RR350 (#2) | 5.02 | 0.03 | — | 0.01 | 0.09 | 1.50 | 0.20 | 0.25 | 0.17 |
| Al7CuMnZr-T6 | Al7Cu (#3) | 6.40 | 0.01 | — | 0.04 | 0.10 | 0.01 | 0.19 | — | 0.13 |

| Alloy | Ti | Sb | Al | Solutn treat. | Ageing treat. | A/B type | ~T (θ'→θ) |
|---|---|---|---|---|---|---|---|
| Al5Cu-T6 | — | — | 94.65 | 530° C. for 5 hrs | 190° C. for 5 hrs | A | <200° C. |
| Al8Si3CuMg-T7 | 0.17 | — | 86.62 | 490° C. for 5 hrs | 240° C. for 5 hrs | A | 200-250° C. |
| Al5CuMg-T6 | 0.02 | — | 93.88 | 530° C. for 5 hrs | 190° C. for 5 hrs | A | 200-250° C.* |
| Al7CuZr-T6 | 0.08 | — | 93.36 | 540° C. for 5 hrs | 240° C. for 4.5 hrs | A | 200-250° C. |
| Al7CuMn-T6 | 0.21 | — | 93.12 | 540° C. for 5 hrs | 240° C. for 4.5 hrs | A/B - trans | 250-350° C. |
| Al5CuNi-T6 | 0.21 | 0.16 | 92.36 | 535° C. for 5 hrs | 220° C. for 4 hrs | B | >350° C. |
| Al7CuMnZr-T6 | 0.09 | — | 93.03 | 540° C. for 5 hrs | 240° C. for 4.5 hrs | B | >350° C. |

Figure 7A:
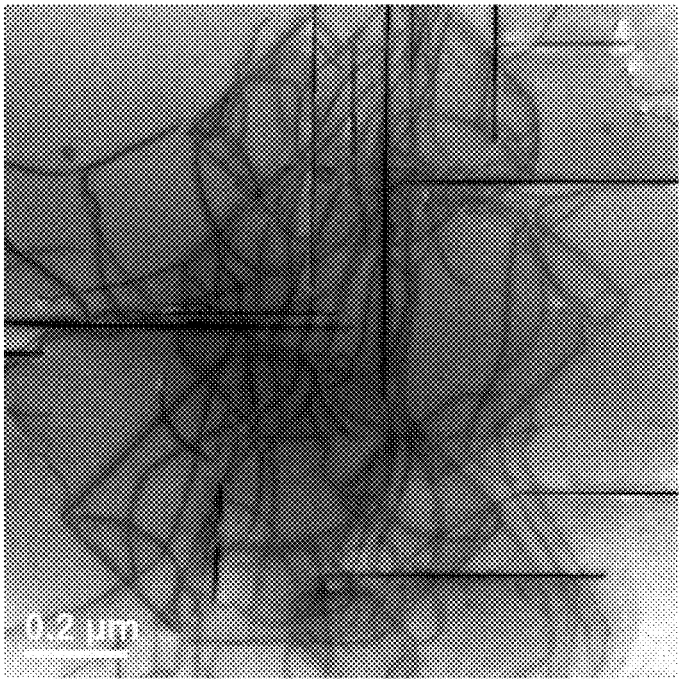
FIGS. 7A and 7B show atomic level imaging and characterization of a type B alloy (Al5CuNi) alloy.
Figure 7B:
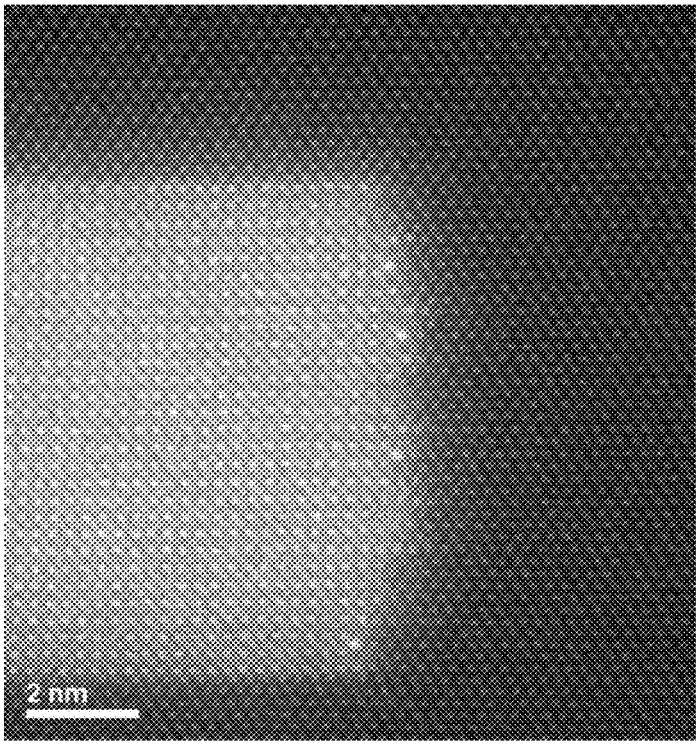
Figure 8:
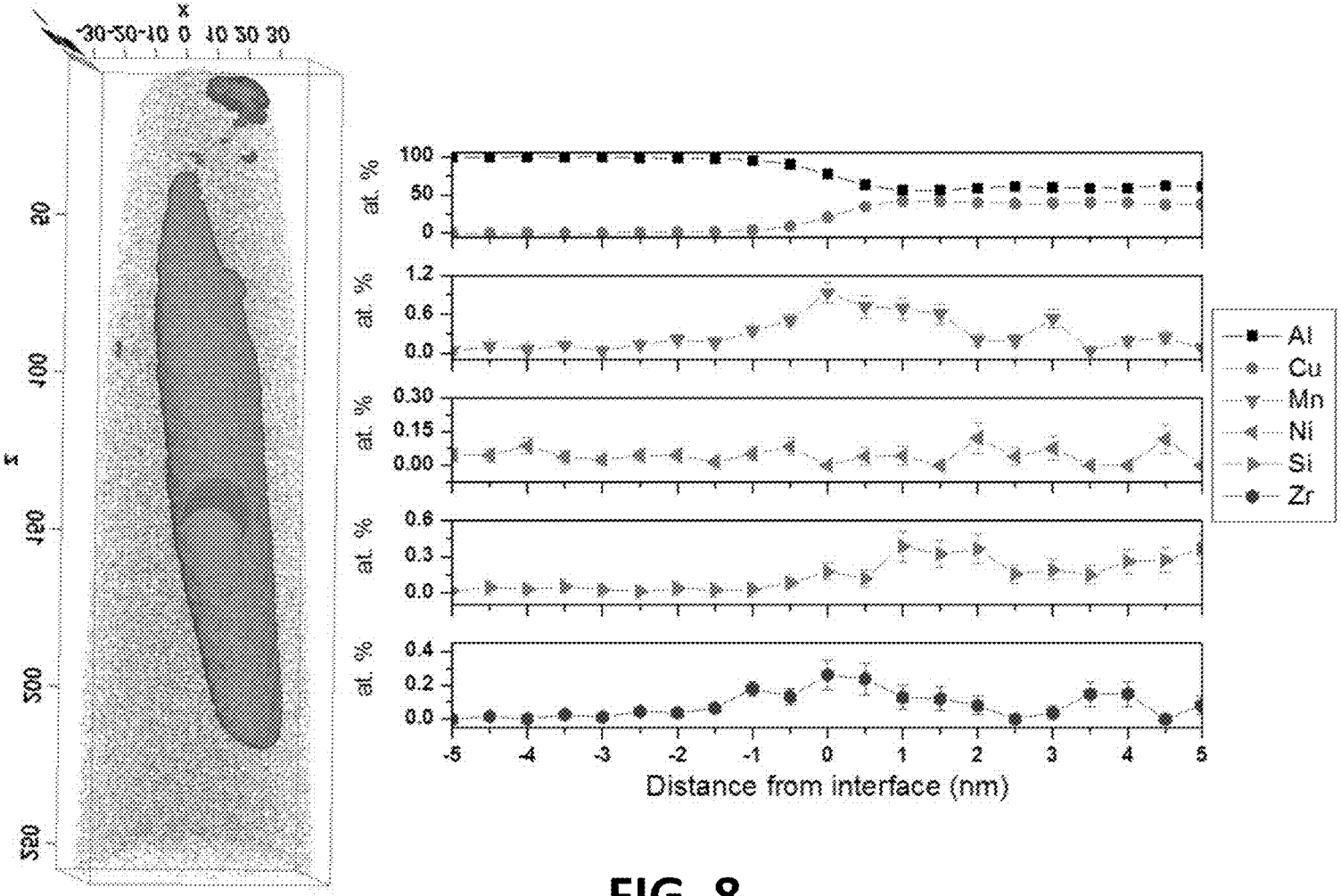
FIG. 8 illustrates results from atom probe analysis for the semi-coherent interface of a specimen preconditioned at 300° C.
Figure 9:
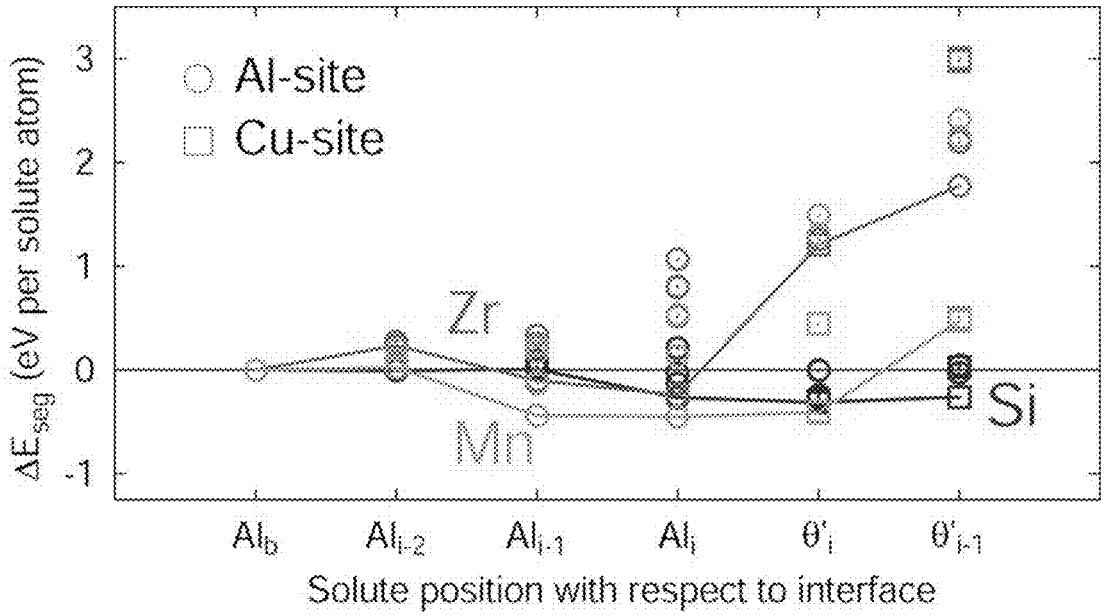
FIG. 9 is a graph illustrating density functional theory (DFT) predictions.
Figure 10:
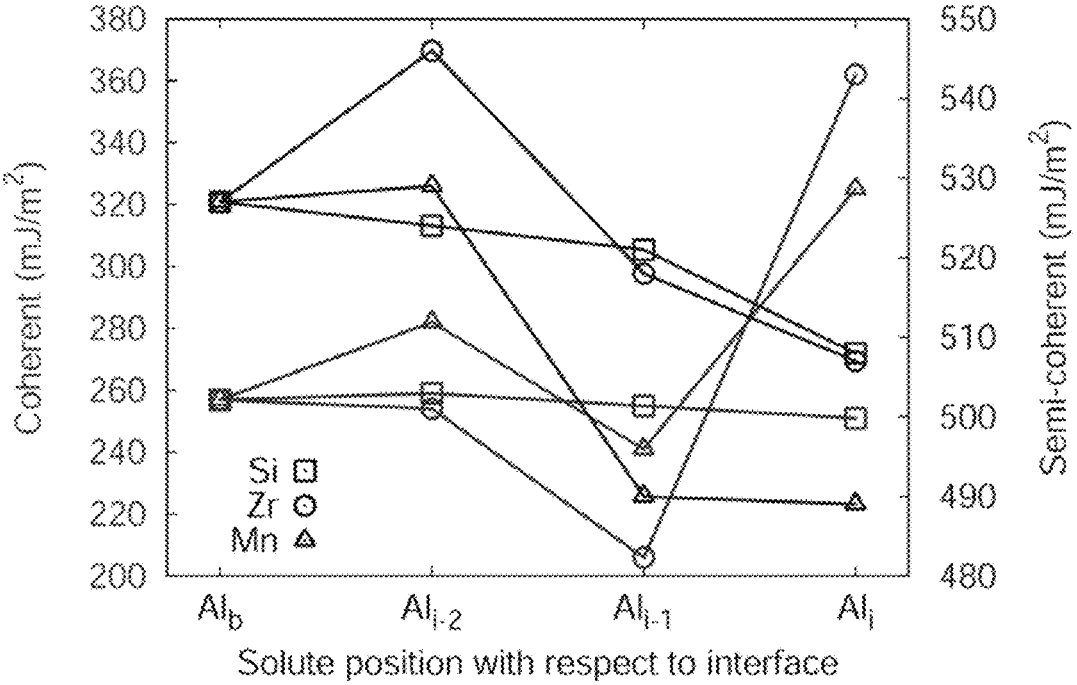
FIG. 10 is a graph illustrating that Mn, Si, and Zr atoms can lower the interfacial energy by segregating to sites near the semi-coherent interface.
Figure 13A:
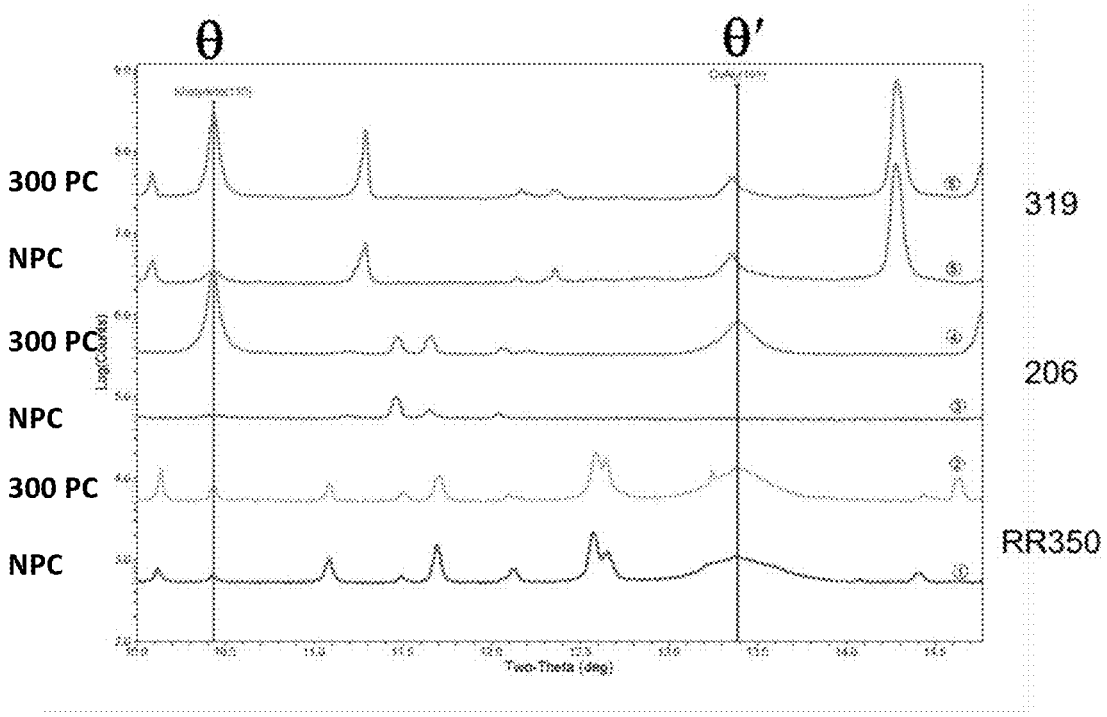
FIGS. 13A and 13B show results from synchrotron x-ray diffraction and TEM (FIG. 13A) analysis of an aluminum alloy embodiment and thermodynamic comparison of theta prime stability (FIG. 13B).

Atomic level imaging and characterization of a prototypical type B alloy (Al5CuNi) alloy is summarized in FIGS. 7A and 7B. FIG. 7A is a bright field TEM image of the Al5CuNi alloy strengthening precipitate in the as-aged condition. As can be seen in FIG. 7A, these precipitates are plate shaped and are present in all three habit (low index 001) planes. Structural analyses by TEM and synchrotron X-ray diffraction (FIG. 13A) confirm that this is the θ' phase with a nominal composition of $Al_2Cu$. The HAADF (high angle annular dark field) image in FIG. 7B (zone axis <011>) reveals a semi-coherent interface (rim of precipitate as shown in the schematic inset in FIG. 7B) across which there is good but not perfect matching of atomic planes. The precipitate plates are faceted as shown in FIG. 7A with longer (110) type facets compared to (100). The longer facets in the matrix zone axis of <011> are the reason why brighter columns of atoms (meaning these atoms at the interface are of elements heavier than Cu atoms in the precipitate) are revealed in the precipitate rim region (arrow in FIG. 7B). These bright atomic columns are likely Zr rich as revealed in the microsegregation of elements at the precipitate-matrix interface in the atom probe tomography scans coupled with the fact that Zr is one of only two elements that are heavier than Cu according to the composition of Al5CuNi (Table 20). The semi-coherent interface is considered because it has higher energy (instability) and mobility, as compared to the coherent interface. The atom probe analysis (FIG. 8) for the semi-coherent interface of a specimen preconditioned at 300° C. revealed the following: (i) there is microsegregation of Mn and Zr atoms on the semi-coherent interface and (ii) Mn and Si atoms partition to the θ' (also summarized in Tables 21 and 22). The atom probe data can be compared with density functional theory (DFT) calculations for lowering of interfacial segregation energy around the strengthening precipitate. FIG. 9 demonstrates that, according to DFT predictions, both Si and Mn atoms will have a tendency to partition to the θ' precipitate whereas Mn atoms also segregate in the precipitate side of the interface. Zirconium atoms are predicted to display a tendency to segregate to the interface on the matrix side. The DFT predictions (FIG. 9) are consistent with the atom probe tomography analysis results (FIG. 8) presented above. In addition, FIG. 10 shows that if the aluminum lattice site three atomic spacings from the interface is considered the bulk, Mn, Si and Zr atoms can lower the interfacial energy by segregating to sites near the semi-coherent interface. According to FIG. 10, Mn atoms are more effective in stabilizing the semi-coherent interface, via interfacial energy reduction, compared to Si or Zr atoms.

TABLE 21

Composition of matrix and precipitate for Al5CuNi for as-aged and 300PC using atom probe tomography

| | | Entity | | | | | | | | |
|---|---|---|---|---|---|---|---|---|---|---|
| | | Al | Cu | Ni | Zr | Mn | Si | Ti | Fe | V |
| | Base alloy | 96.56 | 2.22 | 0.72 | 0.06 | 0.1 | 0.05 | 0.12 | 0.05 | |
| α-Al | As-aged | 99.44 | 0.14 | 0.125 | 0.029 | 0.167 | 0.023 | 0.005 | 0.03 | 0.001 |
| | PC@300° C. | 99.1 | 0.187 | 0.268 | 0.027 | 0.042 | 0.017 | 0.068 | 0.21 | 0.009 |
| θ' | As-aged | 64.05 | 34.96 | 0.084 | 0.192 | 0.174 | 0.23 | 0.003 | 0.194 | |
| | PC@300° C. | 62.29 | 36.4 | 0.06 | 0.063 | 0.48 | 0.236 | 0.06 | 0.27 | 0.004 |

TABLE 22

Composition of matrix and precipitate for Al5CuMg for as-aged and 300PC using atom probe tomography

| | | Entity | | | | | | |
|---|---|---|---|---|---|---|---|---|
| | | Al | Cu | Mg | Mn | Si | Ti | Fe |
| As-aged | Base alloy | 96.83 | 2.27 | 0.42 | 0.13 | 0.14 | 0.124 | 0.075 |
| | α-Al | 98.37 | 1.1 | 0.13 | 0.09 | 0.05 | 0.09 | 0.05 |
| | | 85.27 | 14.15 | | 0.18 | 0.24 | 0.032 | 0.12 |
| | | 63.64 | 23.15 | 6.51 | 0.21 | 6.56 | 0.735 | 0.096 |
| PC@300 C. | α-Al | 99.1 | 0.2 | 0.2 | 0.09 | 0.06 | 0.03 | 0.014 |
| | | 60.15 | 38.65 | 0.08 | 0.37 | 0.14 | 0.014 | 0.25 |

Precipitation hardening in aluminum alloys is well known to proceed through a series of transition phases (GP I→θ"→θ'→θ) to form the equilibrium $Al_2Cu$ (θ) phase. The least thermodynamically stable phases (GP I and θ") have the lowest nucleation barrier due to their coherent interfaces with matrix and, thus, lead to the finest distributions (FIG. 5B). The precipitate distributions become coarser (i.e., in volume terms GP I<θ"<θ'<θ) and increasingly less coherent as the later transition phases appear. The equilibrium θ phase has a complex body-centered tetragonal structure and the resulting high interfacial energy allows a rapid decrease in the hardness of the alloy due to continued minimization of the interfacial free energy of the system by coarsening (FIG. 5D). These results identify and explain a new mechanism by which the metastable disk shaped θ' phase can remain stable up to >350° C., (such that the θ'→θ transition is suppressed) a much higher temperature than previously reported for Al—Cu alloys. The stability of the metastable θ' phase to elevated temperature in type B alloys is demonstrated by comparing the Synchrotron X-ray diffraction profiles of as-aged and 300° C. preconditioned specimens for several alloys in FIG. 13A.

Figure 13B:
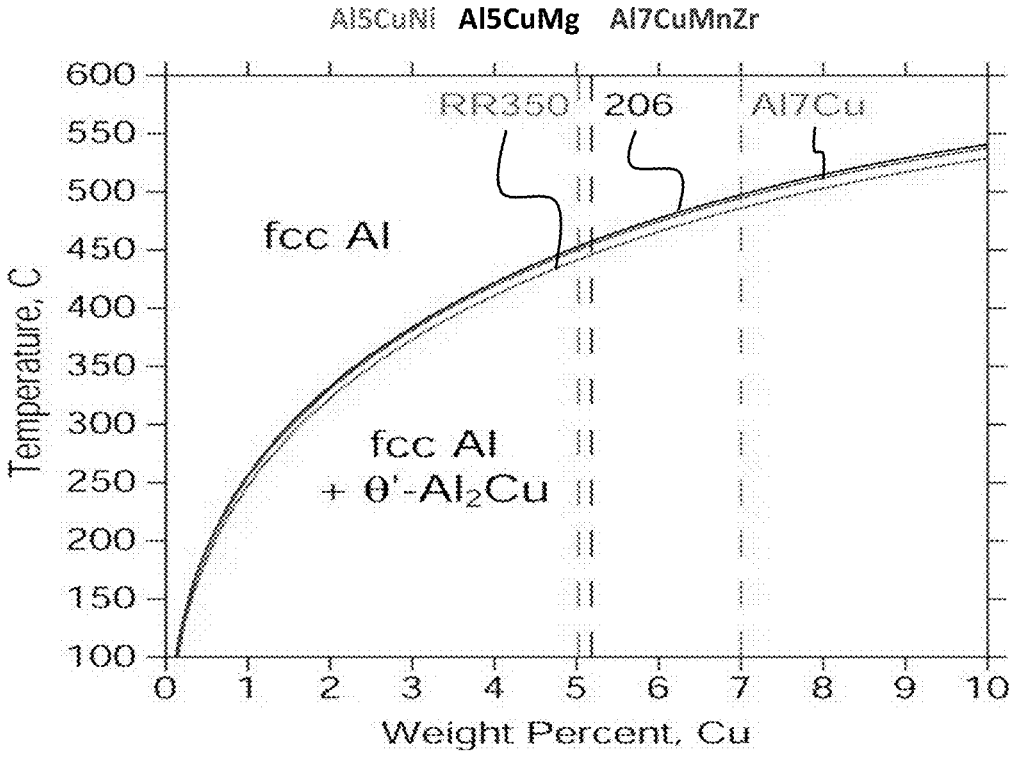
Figure 14A:
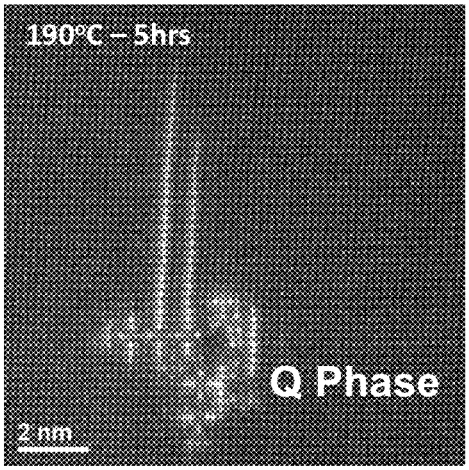
FIGS. 14A-14F are HRTEM images of an alloy composition embodiment showing the evolution of the microstructure of the composition.
Figure 14B:
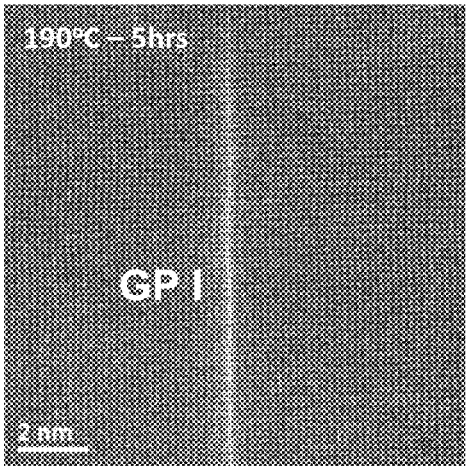
Figure 14C:
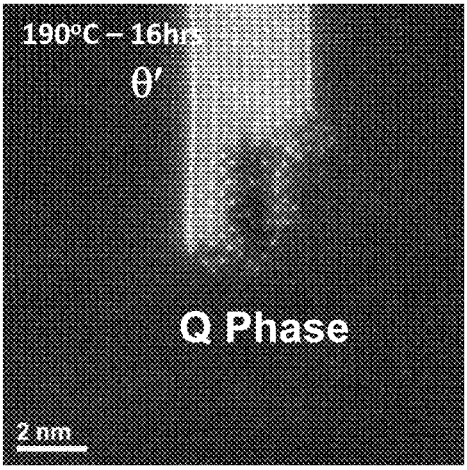
Figure 14D:
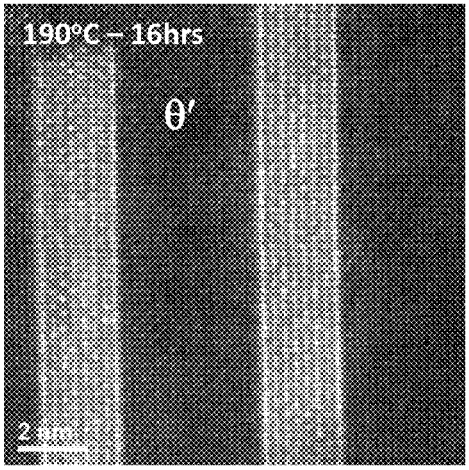
Figure 14E:
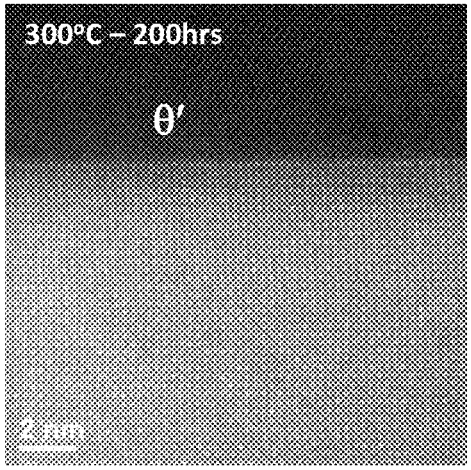
Figure 14F:
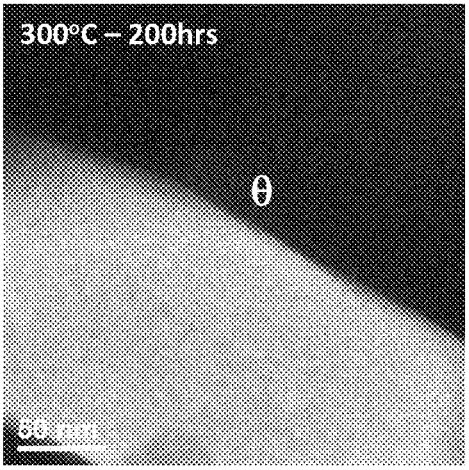

The thermodynamic stability of the θ' phase in type A and type B alloys is comparable according to predictions shown in FIG. 13B. The mechanism for exceptional elevated temperature stability of type B alloys is related to microsegregation of a favorable combination of elements in and around specific interfaces of the strengthening precipitates, as shown experimentally and with first principles calculations in FIGS. 7A, 7B, and 8-10, respectively. To explain further, the modified form of Lifshitz-Slyozov-Wagner (LSW) coarsening kinetics Equation 1 for change in diameter of a θ' disc is introduced:

$$d_t^3 - d_o^3 = \kappa t, \text{ where } \kappa = D\gamma_{sc}X_e \quad (1)$$

which assumes that volume diffusion is the rate controlling step and $d_t$ and do are mean diameters of particles at time, t and t=0, D is the diffusion coefficient, $\gamma_{sc}$ is interfacial energy of the semi-coherent interface and $X_e$ is the equilibrium solubility of very large particles. The strengthening θ' precipitate has two interfacial energies (FIG. 7B), due to possessing both coherent and semi-coherent interfaces in the same precipitate, but we do not discuss the two separately in order to keep the discussion and analysis simple according to Equation 1. As indicated herein, the coarser as-aged microstructure in type B alloys itself provides some measure of coarsening resistance since the basis for Equation 1 is the differential equation $dd_t/dt \propto 1/d_t^2$ indicating larger precipitates coarsen at a slower rate, all else being the same. Calculations have been conducted to show that fine precipitate distributions, of a scale only visible in a TEM, have considerable residual driving force for precipitate coarsening. If the same dispersion is, for example, coarse enough to be observed by optical microscopy, the interfacial energy driving the coarsening process decreases considerably. Larger precipitates are also associated with larger diffusion distances for solute atoms (in this case Cu and other ternary, quanternary elements that partition to the θ') and the larger interprecipitate spacings that provide moderate room temperature mechanical properties make it more difficult for the diffusion fields of neighboring precipitates to overlap. Slow diffusing elements that partition to the θ' can improve the coarsening resistance of the alloy. While factors, such as large and separated θ' precipitates with slow diffusing elements partitioned in the θ' precipitate can help improve the coarsening resistance, they cannot by themselves explain the extreme coarsening resistance of type B alloys at temperatures >250° C., since type A alloy precipitates reach the size scale of type B alloy precipitates but they continue coarsening as evidenced in FIG. 11. Continued coarsening/thickening of θ' precipitates leads to the nucleation of the equilibrium θ phase possible on the θ' precipitate (FIG. 11 and FIG. 14); the equilibrium θ phase has high energy interfaces due to its complex crystal structure and the appearance of this phase accelerates the coarsening rate of type A alloys.

Figure 11:
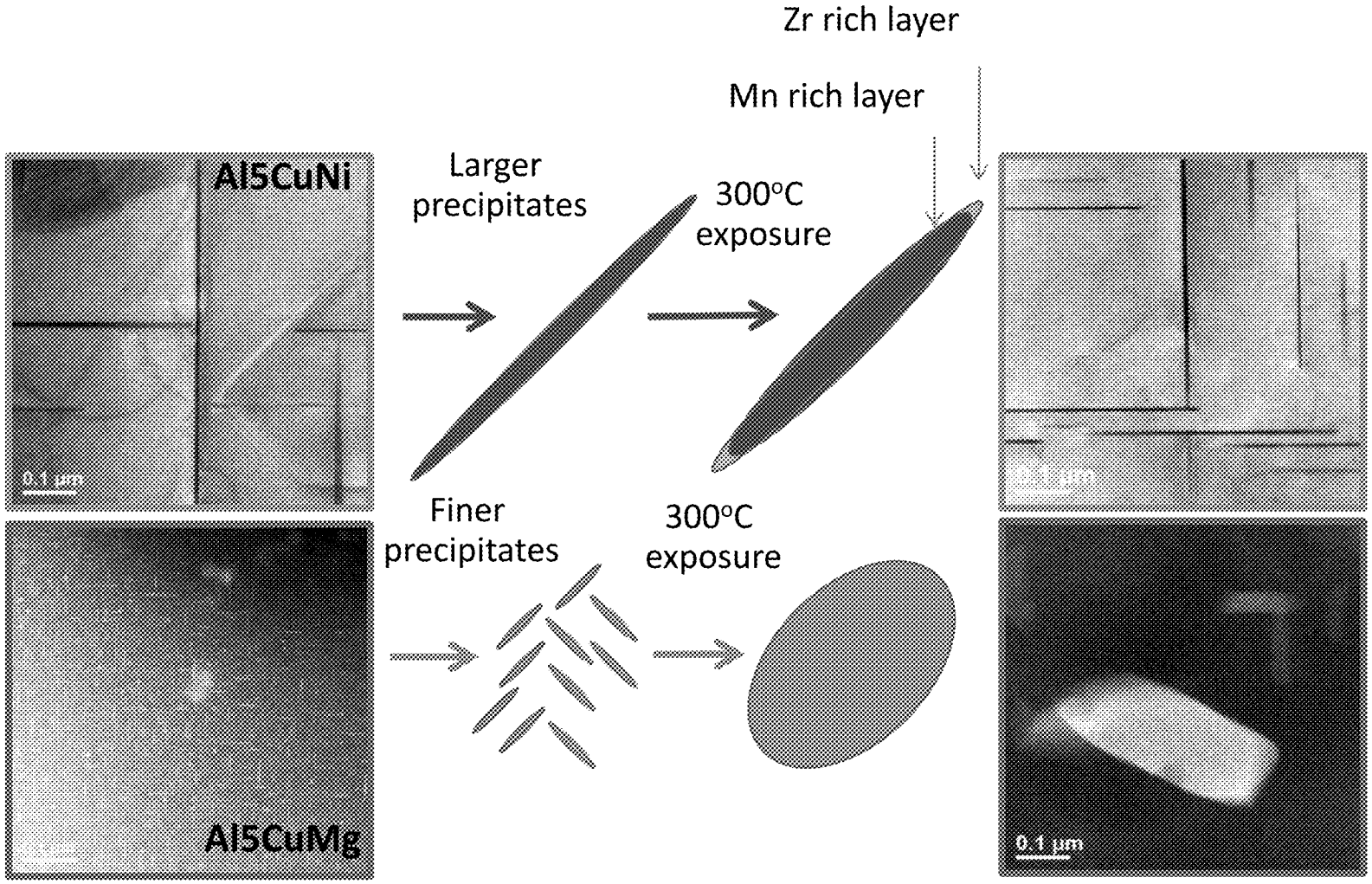
FIG. 11 summarizes the overall interpretation of the differences between type A and type B alloys along with a schematic depiction of core rings of Mn and Zr around the semi-coherent interface of the θ' precipitate.
Figure 15:
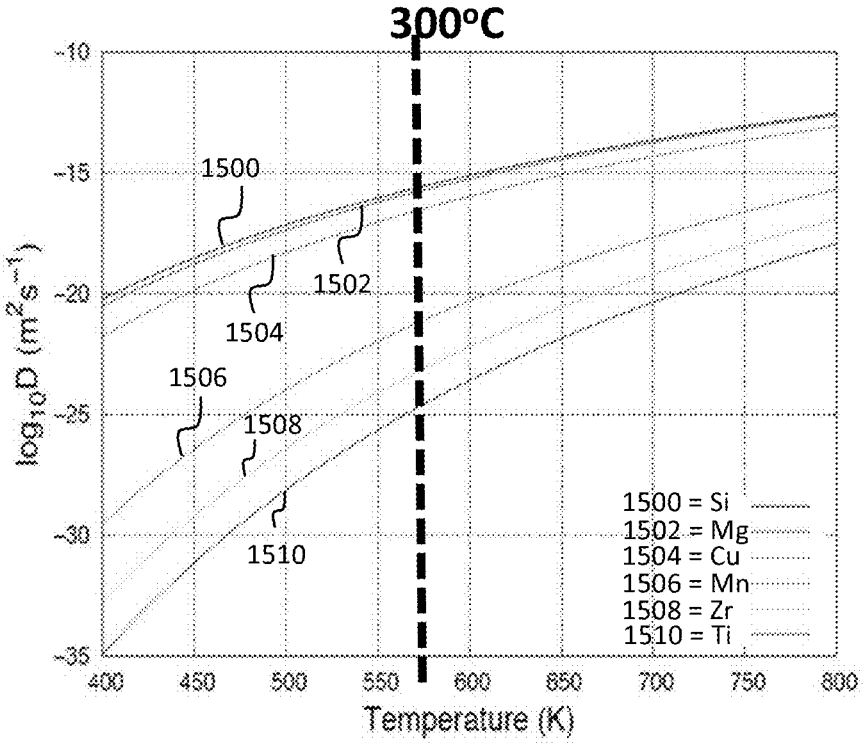
FIG. 15 is a graph of the diffusion coefficients of alloying components in an exemplary alloy.

Without being limited to a particular theory of operation, it is currently believed that a smaller diffusion coefficient and a reduced interfacial energy can lead to improved coarsening resistance and thus it is these factors that can lead to the extreme coarsening resistance of type B alloys. Precipitate growth and coarsening on the coherent surfaces is through a ledge mechanism in this alloy and a key characteristic of type B alloys is a "freezing" of the coarsening of the precipitates over an extended temperature range. The lower energy for the semi-coherent interface in type B alloys is evidenced by facets on the precipitate in FIG. 7A. The segregation of Mn and Zr to the semi-coherent interface (FIGS. 7B and 8) reduces the interfacial energy of the precipitate with Mn being the most effective stabilizer for the semi-coherent interface. The Al5CuMg alloy (type A) precipitates after 300° C. preconditioning also demonstrate segregation of Mn near the semi-coherent interface but the higher Si (~0.25 wt % nominal) content leads to Mn and Si atoms competing for similar locations in the precipitate as shown in FIG. 14 (note: it is concluded that the APT precipitate is the metastable θ' precipitate based on its shape and size and by comparing with TEM image in FIG. 14). Mn atoms, therefore, partition to the θ' precipitate and also segregate to the semi-coherent interface (FIGS. 9 and 10). Si atoms show similar behavior but Mn atoms are more effective in reducing the interfacial energy and moreover, they have a much slower diffusion coefficient (six orders of magnitude lower) in Al at 300° C. (see comparison in FIG. 15). The embodiments disclosed herein demonstrate that an alloy with high levels of Mn and low levels of Si and no Zirconium (FIG. 6) can retain θ' precipitates up to 300° C. but Si levels higher than 0.1 wt % leads to rapid coarsening by θ phase formation (FIG. 15). An alloy that only contains Zr and no Mn (FIG. 6) does not have the desired high temperature stability (like Al—Si alloys), again consistent with the first principles calculations which demonstrate that Zr atoms are no more effective at reducing the interfacial free energy compared to Si atoms. Type B alloys with low Si (<0.1 wt %) and containing Mn and Zr, however, have stable microstructures up to at least 350° C. (e.g. Al5CuNi and Al7CuMnZr). This remarkable level of θ' precipitate stability to extreme homologous temperatures may be due to the fact than Mn and Zr atoms diffuse slowly in aluminum (FIG. 15) and preferentially sandwich the semi-coherent interface (FIGS. 7A and 7B and FIGS. 8-10) of the θ' precipitates to reduce its interfacial energy and the overall coarsening rate for the precipitate according to Equation 1. The atom probe results for the type B Al5CuNi alloy verify this interfacial segregation, as shown in Tables 21 and 22, where the concentration of Zr in the precipitate decreases as a result of the preconditioning at 300° C. but it does not increase in the matrix. The Mn concentration, on the other hand, increases in the precipitate and also along the semi-coherent interface as a result of the 300° C. preconditioning treatment. Together the Mn and Zr atoms reduce the interfacial energy and likely form a double diffusion barrier to effectively make diffusion of Cu and other solute atoms sluggish and increase the coarsening resistance of θ' particles in the type B alloys. In that regard, these precipitates with double diffusion barrier rings are like the core-shell precipitates reported for Al—Sc alloys. FIG. 11 summarizes the key overall interpretation of the differences between type A and type B alloys along with a schematic depiction of core rings of Mn and Zr around the semi-coherent interface of the θ' precipitate. Slowing the coarsening of θ' precipitate in Al—Cu alloys has been reported with ternary alloying additions of Cd, In and Sn where these elements reduce the interfacial energy by segregating to the interface. The mechanism for extreme coarsening resistance disclosed herein, however, is distinct from other coarsening resistance mechanisms reported such as inverse coarsening. In an inverse coarsening mechanism, smaller precipitates can grow at the expense of larger precipitates due to elastic misfit strain energy contributions dominating the surface energy contributions.

In some embodiments, it is noted that in terms of their ability to stabilize the θ' precipitate up to a certain temperature, the alloying elements and combinations thereof can be selected using a hierarchy scheme, which is determined by the temperature at which sustained exposure leads to a rapid drop in hardness such that Al—Cu (<200° C.)<Si addition~Zr addition (200-250° C.)<Mn addition (250-300° C.)<Mn+Zr addition (>350° C.). Such results further indicate that a continuum may exist in the ability of desirable elements and their combinations to stabilize the metastable θ' to a specific temperature. This continuum creates the possibility that newer alloys can be designed that will stabilize the metastable θ' precipitate all the way up to the θ solvus temperature (~420° C. for Al-5Cu in FIG. 13B).

In view of the many possible embodiments to which the principles of the present disclosure may be applied, it should be recognized that the illustrated embodiments are only preferred examples of the disclosure and should not be taken as limiting the scope of the claimed invention. Rather, the scope of the invention is defined by the following claims. We therefore claim as our invention all that comes within the scope and spirit of these claims.

We claim:

1. A composition, comprising:

(i) an alloy component comprising
6.6 wt % to 8 wt % copper,
0.18 wt % to 0.3 wt % zirconium,
0.05 wt % to less than 0.5 wt % manganese,
less than 0.1 wt % silicon,
zero to less than 0.01 wt % magnesium,
titanium, and
a balance of aluminum; and (ii) an amount of a grain refiner component comprising 2 wt % to 6 wt % titanium, 0.5 wt % to 2 wt % boron, and a remainder wt % of aluminum;

wherein any vanadium, if present in the alloy, is provided solely by unavoidable impurities and wherein the composition provides a cast alloy that exhibits an average hot tearing value ranging from 1.5 to 2.5.

2. The composition of claim 1, further comprising 0.05 wt % to less than 0.2 wt % iron.

3. The composition of claim 2, wherein the wt % of manganese is greater than the wt % of iron.

4. The composition of claim 1, wherein the wt % of zirconium is greater than the wt % of titanium present in the alloy component.

5. The composition of claim 1, further comprising nickel, cobalt, antimony, or a combination thereof.

6. The composition of claim 5, wherein the nickel is present in an amount ranging from greater than 0 wt % to less than 0.01 wt %; the cobalt is present in an amount ranging from greater than 0 wt % to less than 0.1 wt %; the antimony is present in an amount ranging from greater than 0 wt % to less than 0.1 wt %; or a combination thereof.

7. The composition of claim 1, wherein the manganese is present in an amount greater than 3 times the amount of silicon present.

8. The composition of claim 1, wherein the wt % of the manganese ranges from 0.1 wt % to less than 0.5 wt %.

9. The composition of claim 1, wherein the amount of the grain refiner component is an amount sufficient to provide an additional 0.02 wt % to 0.2 wt % titanium to the composition.

10. The composition of claim 1, wherein the composition comprises 7 wt % to 8 wt % copper, 0.1 wt % to less than 0.5 wt % manganese, 0.18 wt % zirconium, greater than 0.2 wt % and up to 0.4 wt % titanium, greater than 0 wt % to 0.02 wt % boron, and 85-93 wt % aluminum.

11. The composition of claim 1, wherein the composition provides a cast alloy comprising strengthening precipitates having an aspect ratio ranging from 30 to 40.

12. An engine component made with the composition of claim 1.

13. A method for making the composition of claim 1, comprising:

combining the alloy component with the grain refiner component to provide the composition;

solution treating the composition at a temperature ranging from 525° C. to 540° C.; and age treating the composition at a temperature ranging from 210° C. to 250° C. or at a temperature ranging from 175° C. to 190° C.

* * * * *